US011399228B2

(12) United States Patent
Liang et al.

(10) Patent No.: US 11,399,228 B2
(45) Date of Patent: Jul. 26, 2022

(54) ACOUSTIC TRANSDUCER, WEARABLE SOUND DEVICE AND MANUFACTURING METHOD OF ACOUSTIC TRANSDUCER

(71) Applicant: xMEMS Labs, Inc., Santa Clara, CA (US)

(72) Inventors: Jemm Yue Liang, Sunnyvale, CA (US); Chiung C. Lo, San Jose, CA (US); Martin George Lim, Hillsborough, CA (US); Wen-Chien Chen, New Taipei (TW); Michael David Housholder, San Jose, CA (US); David Hong, Los Altos, CA (US)

(73) Assignee: xMEMS Labs, Inc., Santa Clara, CA (US)

( * ) Notice: Subject to any disclaimer, the term of this patent is extended or adjusted under 35 U.S.C. 154(b) by 0 days.

(21) Appl. No.: 17/344,980

(22) Filed: Jun. 11, 2021

(65) Prior Publication Data

US 2022/0014838 A1 Jan. 13, 2022

Related U.S. Application Data

(60) Provisional application No. 63/171,919, filed on Apr. 7, 2021, provisional application No. 63/051,885, filed (Continued)

(51) Int. Cl.
*H04R 1/10* (2006.01)

(52) U.S. Cl.
CPC ..... *H04R 1/1075* (2013.01); *H04R 1/1016* (2013.01); *H04R 1/1066* (2013.01); *H04R 2460/11* (2013.01)

(58) Field of Classification Search
CPC .. H04R 1/1075; H04R 1/1016; H04R 1/1066; H04R 2460/11
See application file for complete search history.

(56) References Cited

U.S. PATENT DOCUMENTS 8,724,200 B1 5/2014 Wu
2007/0007858 A1 1/2007 Sorensen
(Continued)

OTHER PUBLICATIONS

Hyonse Kim et al., A slim type microvalve driven by PZT films, Sensors and Actuators A: Physical, Jan. 18, 2005, pp. 162-171, vol. 121, Elsevier B. V., XP027806904.

(Continued)

*Primary Examiner* — Alexander Krzystan
*Assistant Examiner* — Julie X Dang
(74) *Attorney, Agent, or Firm* — Winston Hsu

(57) ABSTRACT

An acoustic transducer is configured to perform an acoustic transformation. The acoustic transducer is disposed within a wearable sound device or to be disposed within the wearable sound device. The acoustic transducer includes at least one anchor structure, a film structure and an actuator. The film structure is disposed within a first layer and anchored by the anchor structure disposed within a second layer. The actuator is disposed on the film structure, and the actuator is configured to actuate the film structure to form a vent temporarily. The film structure partitions a space into a first volume to be connected to an ear canal of a wearable sound device user and a second volume to be connected to an ambient of the wearable sound device. The ear canal and the ambient are to be connected via the vent temporarily opened when the film structure is actuated.

15 Claims, 31 Drawing Sheets

Related U.S. Application Data on Jul. 14, 2020, provisional application No. 63/050,763, filed on Jul. 11, 2020.

(56) References Cited

U.S. PATENT DOCUMENTS

| | | | | |
|---|---|---|---|---|
| 2012/0053393 | A1 | 3/2012 | Kaltenbacher | |
| 2013/0121509 | A1 | 5/2013 | Hsu | |
| 2013/0223023 | A1 | 8/2013 | Dehe | |
| 2015/0163599 | A1* | 6/2015 | Shim | B81C 1/00182 381/150 |
| 2016/0176704 | A1 | 6/2016 | Cargill | |
| 2017/0021391 | A1 | 1/2017 | Guedes | |
| 2017/0164115 | A1 | 6/2017 | van Halteren | |
| 2017/0201192 | A1 | 7/2017 | Tumpold | |
| 2017/0217761 | A1 | 8/2017 | Chung | |
| 2017/0260044 | A1 | 9/2017 | Cargill | |
| 2017/0325030 | A1 | 11/2017 | Stoppel | |
| 2019/0039880 | A1 | 2/2019 | Paci | |
| 2019/0098390 | A1 | 3/2019 | Carino | |
| 2019/0349665 | A1 | 11/2019 | Grinker | |
| 2020/0100033 | A1 | 3/2020 | Stoppel | |
| 2020/0178000 | A1 | 6/2020 | Niekiel | |
| 2020/0211521 | A1* | 7/2020 | Voss | H04R 7/04 |
| 2020/0213770 | A1 | 7/2020 | Duan | |

OTHER PUBLICATIONS

Liang, the specification, including the claims, and drawings in the U.S. Appl. No. 17/344,983, filed Jun. 11, 2021.

* cited by examiner

ACOUSTIC TRANSDUCER, WEARABLE SOUND DEVICE AND MANUFACTURING METHOD OF ACOUSTIC TRANSDUCER

CROSS REFERENCE TO RELATED APPLICATIONS

This application claims the benefits of U.S. provisional application No. 63/050,763, filed on Jul. 11, 2020, U.S. provisional application No. 63/051,885, filed on Jul. 14, 2020, and U.S. provisional application No. 63/171,919, filed on Apr. 7, 2021, which are all incorporated herein by reference.

BACKGROUND OF THE INVENTION

1. Field of the Invention

The present application relates to an acoustic transducer, a wearable sound device and a manufacturing method of an acoustic transducer, and more particularly, to an acoustic transducer capable of suppressing an occlusion effect, to a wearable sound device having an acoustic transducer and to a manufacturing method of an acoustic transducer.

2. Description of the Prior Art

Nowadays, wearable sound devices, such as in-ear (insert into ear canal) earbuds, on-ear or over-ear earphones, etc. are generally used for producing sound or receiving sound. Magnet and moving coil (MMC) based microspeaker have been developed for decades and widely used in many such devices. Recently, MEMS (Micro Electro Mechanical System) acoustic transducers which make use of a semiconductor fabrication process can be sound producing/receiving components in the wearable sound devices.

Occlusion effect is due to the sealed volume of ear canal causing loud perceived sound pressure by the listener. For example, the occlusion effect occurs while the listener does specific motion(s) generating a bone-conducted sound (such as walking, jogging, talking, eating, touching the acoustic transducer, etc.) and uses the wearable sound device (e.g., the wearable sound device is filled in his/her ear canal). The occlusion effect is particularly strong toward bass due to the difference of acceleration based SPL (sound pressure level) generation ($SPL \propto a = dD^2/dt^2$) and compression based SPL generation ($SPL \propto D$). For instance, a displacement of merely 1 μm at 20 Hz will cause a SPL=1 μm/25 mm atm=106 dB in occluded ear canal (25 mm is average length of adult ear canals). Therefore, if the occlusion effect occurs, listener hears the occlusion noise, and the quality of listener experience is bad.

In the traditional technology, the wearable sound device has an airflow channel existing between the ear canal and the ambient external to the device, such that the pressure caused by the occlusion effect can be released from this airflow channel to suppress the occlusion effect. However, because the airflow channel always exists, in the frequency response, the SPL in the lower frequency (e.g., lower than 500 Hz) has a significant drop. For example, if the traditional wearable sound device uses a typical 115 dB speaker driver, the SPL in 20 Hz is much lower than 110 dB. In addition, if a size of a fixed vent configured to form the airflow channel is greater, the SPL drop will be greater, and the water and dust protection will become more difficult.

In some cases, the traditional wearable sound device may use a speaker driver stronger than the typical 115 dB speaker driver to compensate for the loss of SPL in lower frequency due to the existence of the airflow channel. For example, assuming the loss of SPL is 20 dB, then the required speaker driver to maintain the same 115 dB SPL in the presence of the airflow channel will be 135 dB SPL, were it to be used in a sealed ear canal. However, the 10× stronger bass output requires the speaker membrane travel to also increase by 10× which implies the heights of both the coil and the magnet flux gap of the speaker driver need to be increased by 10×. Thus, it is difficult to make the traditional wearable sound device having the strong speaker driver have the small size and light weight.

Therefore, it is necessary to improve the prior art, so as to suppress the occlusion effect.

SUMMARY OF THE INVENTION

It is therefore a primary objective of the present invention to provide an acoustic transducer capable of suppressing an occlusion effect, and to provide a wearable sound device having an acoustic transducer and a manufacturing method of an acoustic transducer.

An embodiment of the present invention provides an acoustic transducer configured to perform an acoustic transformation. The acoustic transducer is disposed within a wearable sound device or to be disposed within the wearable sound device. The acoustic transducer includes at least one anchor structure, a film structure and an actuator. The film structure is disposed within a first layer and anchored by the anchor structure disposed within a second layer. The actuator is disposed on the film structure, and the actuator is configured to actuate the film structure to form a vent temporarily. The film structure partitions a space into a first volume to be connected to an ear canal of a wearable sound device user and a second volume to be connected to an ambient of the wearable sound device. The ear canal and the ambient are to be connected via the vent temporarily opened when the film structure is actuated.

Another embodiment of the present invention provides a manufacturing method for an acoustic transducer. The manufacturing method includes: providing a wafer, wherein the wafer includes a first layer and a second layer; forming and patterning an actuating material formed on a first side of the wafer; patterning the first layer of the wafer, so as to form a trench line; and removing a first part of the second layer of the wafer. A second part of the second layer forms at least one anchor structure, and the patterned first layer forms a film structure anchored by the anchor structure. A slit is formed within and penetrates through the film structure because of the trench line. The film structure is configured to be actuated to form a vent temporarily, and the vent is formed because of the slit. The film structure partitions a space into a first volume to be connected to an ear canal and a second volume to be connected to an ambient of the wearable sound device. The ear canal and the ambient are to be connected via the vent temporarily opened.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
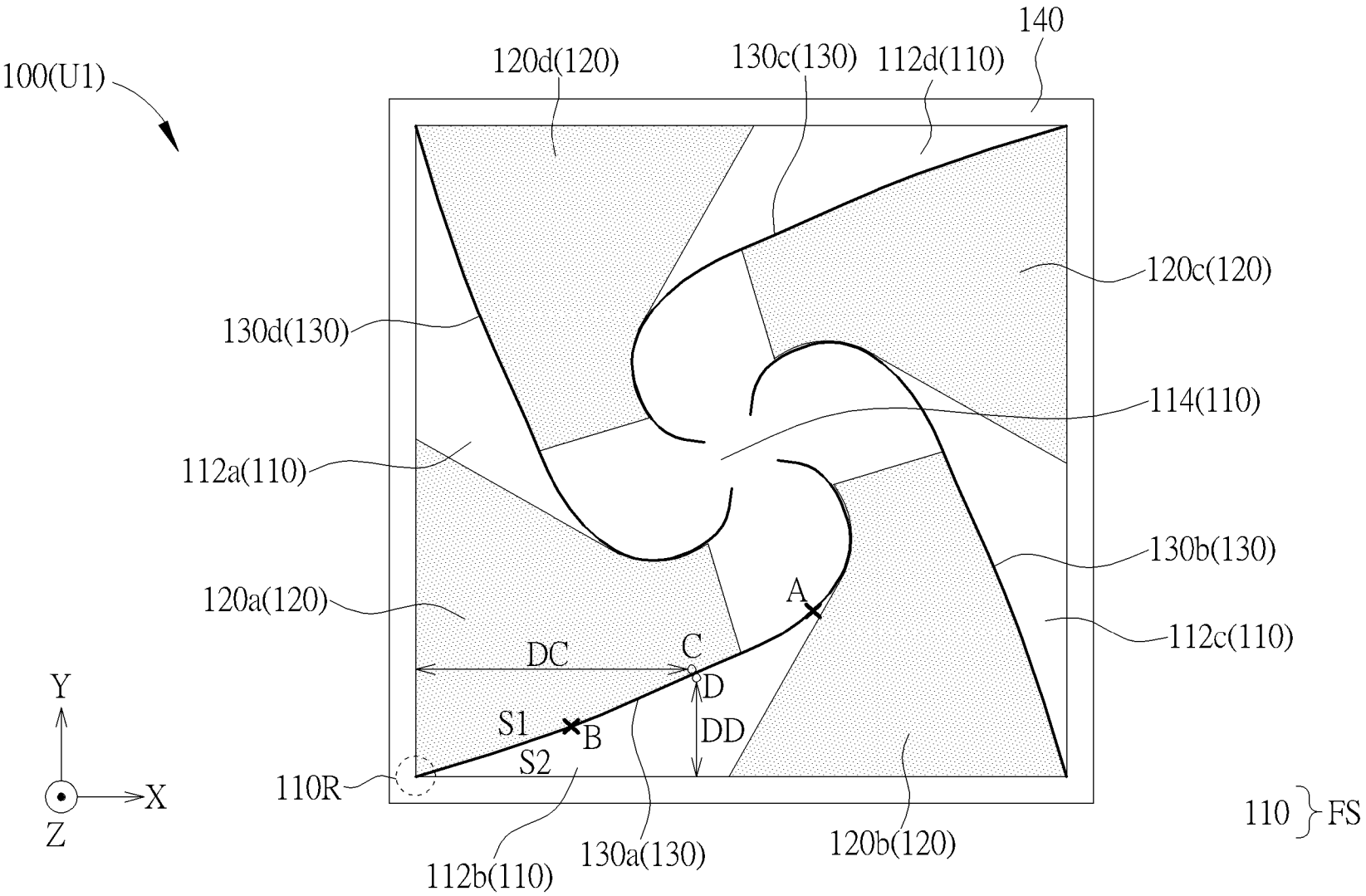
FIG. 1 is a schematic diagram of a top view illustrating an acoustic transducer according to a first embodiment of the present invention.

To provide a better understanding of the present invention to those skilled in the art, preferred embodiments and typical material or range parameters for key components will be detailed in the follow description. These preferred embodiments of the present invention are illustrated in the accompanying drawings with numbered elements to elaborate on the contents and effects to be achieved. It should be noted that the drawings are simplified schematics, and the material and parameter ranges of key components are illustrative based on the present day technology, and therefore show only the components and combinations associated with the present invention, so as to provide a clearer description for the basic structure, implementing or operation method of the present invention. The components would be more complex in reality and the ranges of parameters or material used may evolve as technology progresses in the future. In addition, for ease of explanation, the components shown in the drawings may not represent their actual number, shape, and dimensions; details may be adjusted according to design requirements.

In the following description and in the claims, the terms "include", "comprise" and "have" are used in an open-ended fashion, and thus should be interpreted to mean "include, but not limited to . . . ". Thus, when the terms "include", "comprise" and/or "have" are used in the description of the present invention, the corresponding features, areas, steps, operations and/or components would be pointed to existence, but not limited to the existence of one or a plurality of the corresponding features, areas, steps, operations and/or components.

In the following description and in the claims, when "a A1 component is formed by/of B1", B1 exist in the formation of A1 component or B1 is used in the formation of A1 component, and the existence and use of one or a plurality of other features, areas, steps, operations and/or components are not excluded in the formation of A1 component.

In the following description and in the claims, the term "substantially" generally means a small deviation may exist or not exist. For instance, the terms "substantially parallel" and "substantially along" means that an angle between two components may be less than or equal to a certain degree threshold, e.g., 10 degrees, 5 degrees, 3 degrees or 1 degree. For instance, the term "substantially aligned" means that a deviation between two components may be less than or equal to a certain difference threshold, e.g., 2 μm or 1 μm. For instance, the term "substantially the same" means that a deviation is within, e.g., 10% of a given value or range, or mean within 5%, 3%, 2%, 1%, or 0.5% of a given value or range.

Although terms such as first, second, third, etc., may be used to describe diverse constituent elements, such constituent elements are not limited by the terms. The terms are used only to discriminate a constituent element from other constituent elements in the specification, and the terms do not relate to the sequence of the manufacture if the specification do not describe. The claims may not use the same terms, but instead may use the terms first, second, third, etc. with respect to the order in which an element is claimed. Accordingly, in the following description, a first constituent element may be a second constituent element in a claim.

It should be noted that the technical features in different embodiments described in the following can be replaced, recombined, or mixed with one another to constitute another embodiment without departing from the spirit of the present invention.

In the present invention, the acoustic transducer may perform an acoustic transformation, wherein the acoustic transformation may convert signals (e.g. electric signals or signals with other suitable type) into an acoustic wave, or may convert an acoustic wave into signals with other suitable type (e.g. electric signals). In some embodiments, the acoustic transducer may be a sound producing device, a speaker, a micro speaker or other suitable device, so as to convert the electric signals into the acoustic wave, but not limited thereto. In some embodiments, the acoustic transducer may be a sound measuring device, a microphone or other suitable device, so as to convert the acoustic wave into the electric signals, but not limited thereto.

In the following, the acoustic transducer may be an exemplary sound producing device which configured to make those skilled in the art better understand the present invention, but not limited thereto. In the following, the acoustic transducer may be disposed within a wearable sound device (e.g., an in-ear device) for instance, but not limited thereto. Note that an operation of the acoustic transducer means that the acoustic transformation is performed by the acoustic transducer (e.g., the acoustic wave is produced by actuating the acoustic transducer with electrical driving signal).

Figure 2:
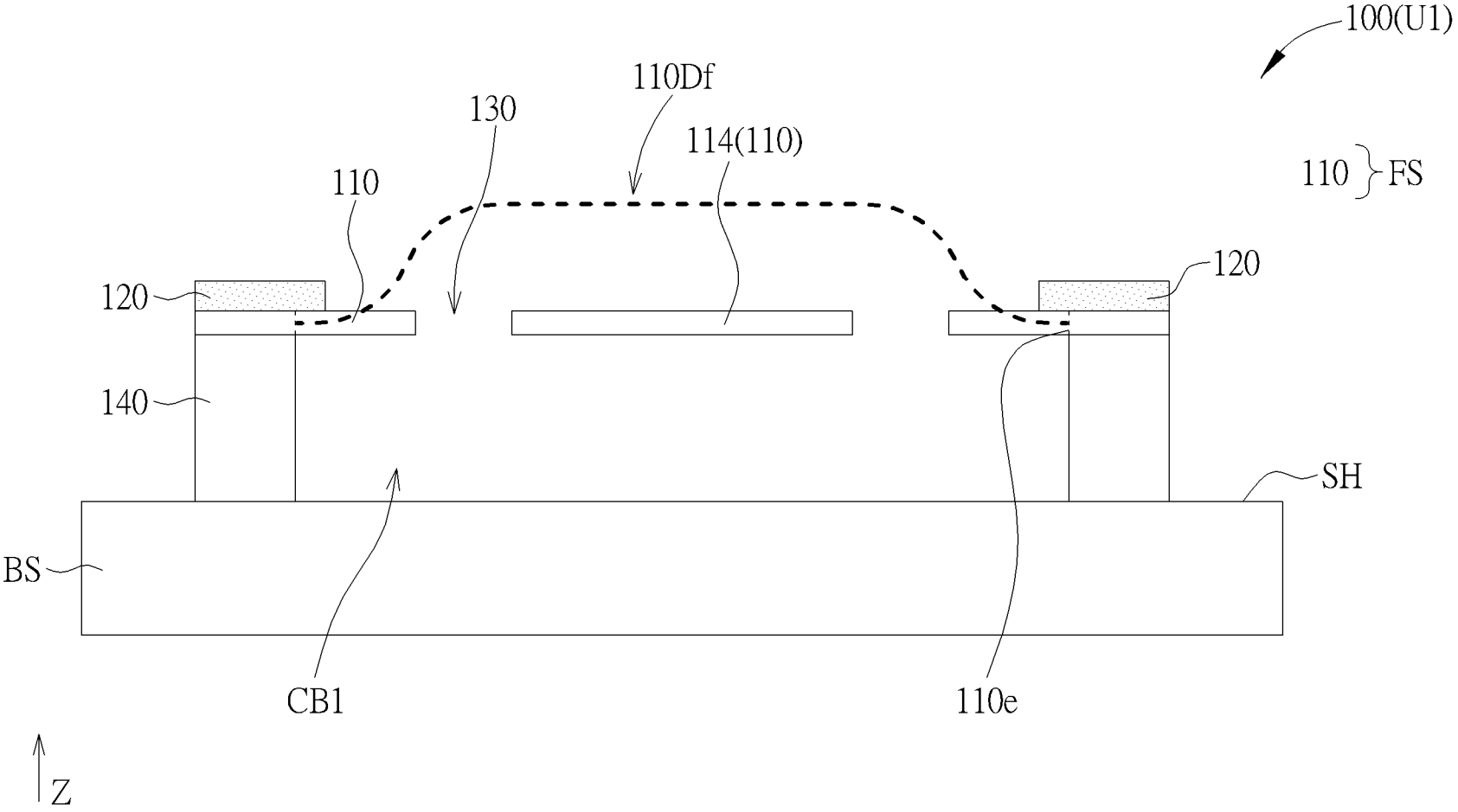
FIG. 2 is a schematic diagram of a cross sectional view illustrating an acoustic transducer according to the first embodiment of the present invention.
Figure 3:
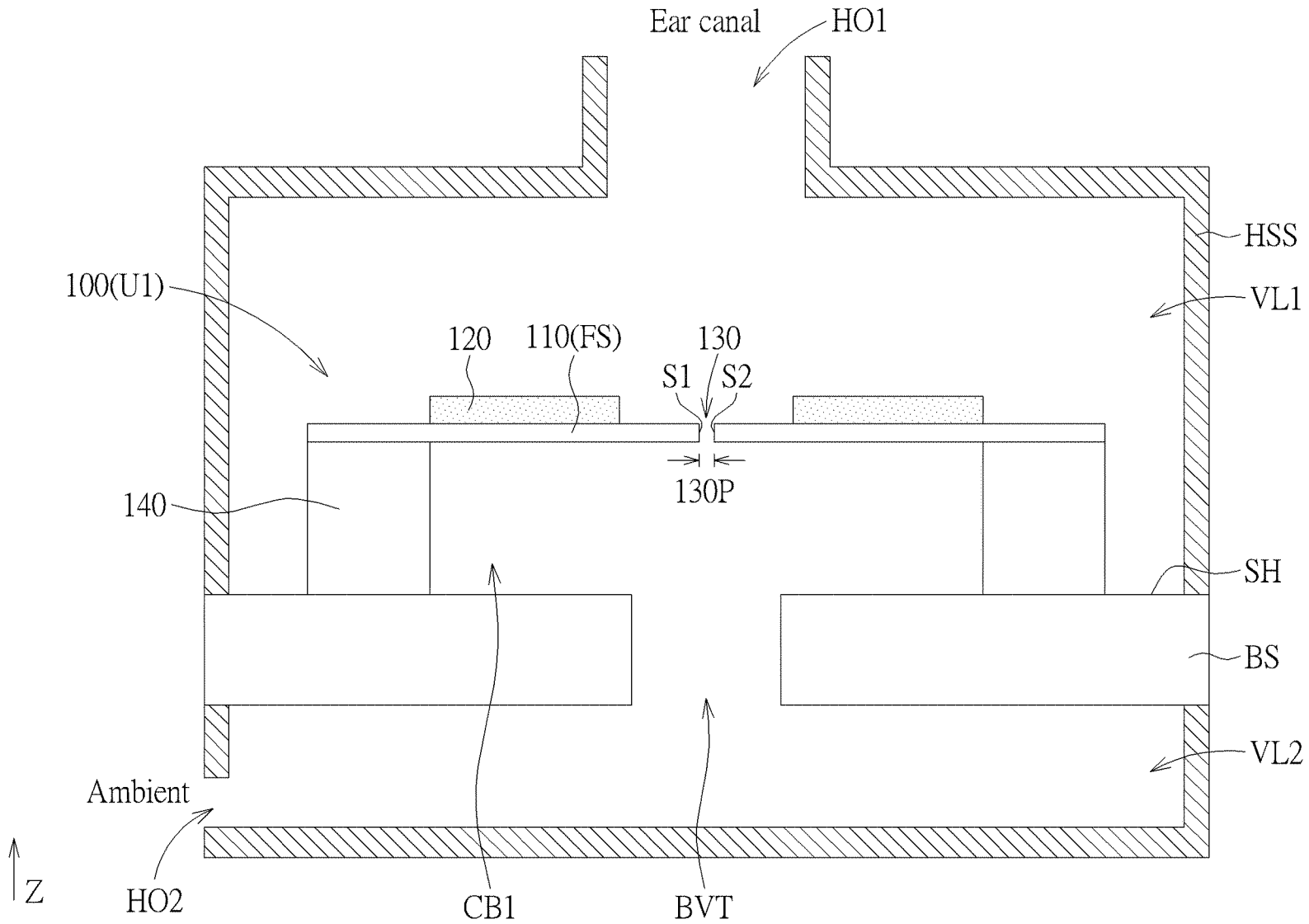
FIG. 3 is a schematic diagram of a cross sectional view illustrating an acoustic transducer and a housing structure according to the first embodiment of the present invention.

Referring to FIG. 1 to FIG. 3, FIG. 1 is a schematic diagram of a top view illustrating an acoustic transducer according to a first embodiment of the present invention, FIG. 2 is a schematic diagram of a cross sectional view illustrating an acoustic transducer according to the first embodiment of the present invention, and FIG. 3 is a schematic diagram of a cross sectional view illustrating an acoustic transducer and a housing structure according to the first embodiment of the present invention. As shown in FIG. 1 and FIG. 2, the acoustic transducer 100 includes a base BS. The base BS may be hard or flexible, wherein the base BS may include silicon, germanium, glass, plastic, quartz, sapphire, metal, polymer (e.g., polyimide (PI), polyethylene terephthalate (PET)), any other suitable material or a combination thereof. As an example, the base BS may be a circuit board including a laminate (e.g. copper clad laminate, CCL), a land grid array (LGA) board or any other suitable board containing conductive material, but not limited thereto.

In FIG. 1 and FIG. 2, the base BS has a horizontal surface SH parallel to a direction X and a direction Y, wherein the direction Y is not parallel to the direction X (e.g., the direction X may be perpendicular to the direction Y). Note that the direction X and the direction Y of the present invention may be considered as horizontal directions.

The acoustic transducer 100 includes a film structure FS and at least one anchor structure 140 disposed on the horizontal surface SH of the base BS, wherein the film structure FS is anchored by the anchor structure 140. As shown in FIG. 1, the acoustic transducer 100 may include four anchor structures 140, and the film structure FS includes a first membrane 110. The anchor structure 140 is disposed outside the first membrane 110 and connected to at least one of outer edges 110*e* of the first membrane 110, wherein the outer edges 110*e* of the first membrane 110 define a boundary of the first membrane 110. For example, the anchor structures 140 may surround the first membrane 110 and be connected to all outer edges 110*e* of the first membrane 110, but not limited thereto.

In the operation of the acoustic transducer 100, the first membrane 110 can be actuated to have a movement. In this embodiment, the first membrane 110 may be actuated to move upwardly and downwardly, but not limited thereto. For example, in FIG. 2, when the first membrane 110 is actuated, the first membrane 110 may deform into a deformed type 110Df, but not limited thereto. Note that, in the present invention, the terms "move upwardly" and "move downwardly" represent that the membrane moves substantially along a direction Z parallel to a normal direction of the first membrane 110 or parallel to a normal direction of the horizontal surface SH of the base BS (i.e., the direction Z may be perpendicular to the direction X and the direction Y).

During the operation of the acoustic transducer 100, the anchor structure 140 may be immobilized. Namely, the anchor structure 140 may be a fixed end (or fixed edge) respecting the first membrane 110 during the operation of the acoustic transducer 100.

The first membrane 110 (the film structure FS) and the anchor structure 140 may include any suitable material(s). In some embodiments, the first membrane 110 (the film structure FS) and the anchor structure 140 may individually include silicon (e.g., single crystalline silicon or poly-crystalline silicon), silicon compound (e.g., silicon carbide, silicon oxide), germanium, germanium compound (e.g., gallium nitride or gallium arsenide), gallium, gallium compound, stainless steel or a combination thereof, but not limited thereto. The first membrane 110 and the anchor structure 140 may have the same material or different materials.

In addition, owing to the existence of the first membrane 110 and the anchor structure 140, a first chamber CB1 may exist between the base BS and the first membrane 110. In this embodiment, the base BS may further include a back vent BVT (e.g., the back vent BVT shown in FIG. 3), and the first chamber CB1 may be connected to the rear outside of the acoustic transducer 100 (i.e., a space back of the base BS) through the back vent BVT.

The acoustic transducer 100 includes a first actuator 120 disposed on the first membrane 110 (the film structure FS) and configured to actuate the first membrane 110 (the film structure FS). For instance, in FIG. 1 and FIG. 2, the first actuator 120 may be in contact with the first membrane 110, but not limited thereto. Furthermore, in this embodiment, as shown in FIG. 1 and FIG. 2, the first actuator 120 may not totally overlap the first membrane 110, as shown in the direction Z perspective of FIG. 1, but not limited thereto. Optionally, in FIG. 2, the first actuator 120 may be disposed on and overlap the anchor structure 140, but not limited thereto. In another embodiment, the first actuator 120 may not overlap the anchor structure 140, as shown in the direction Z perspective of FIG. 1, but not limited thereto.

The first actuator 120 has a monotonic electromechanical converting function with respect to the movement of the first membrane 110 along the direction Z. In some embodiments, the first actuator 120 may include a piezoelectric actuator, an electrostatic actuator, a nanoscopic-electrostatic-drive (NED) actuator, an electromagnetic actuator or any other suitable actuator, but not limited thereto. For example, in an embodiment, the first actuator 120 may include a piezoelectric actuator, the piezoelectric actuator may contain such as two electrodes and a piezoelectric material layer (e.g., lead zirconate titanate, PZT) disposed between the electrodes, wherein the piezoelectric material layer may actuate the first membrane 110 based on driving signals (e.g., driving voltages) received by the electrodes, but not limited thereto. For example, in another embodiment, the first actuator 120 may include an electromagnetic actuator (such as a planar coil), wherein the electromagnetic actuator may actuate the first membrane 110 based on a received driving signals (e.g., driving current) and a magnetic field (i.e. the first membrane 110 may be actuated by the electromagnetic force), but not limited thereto. For example, in still another embodiment, the first actuator 120 may include an electrostatic actuator (such as conducting plate) or a NED actuator, wherein the electrostatic actuator or the NED actuator may actuate the first membrane 110 based on a received driving signals (e.g., driving voltage) and an electrostatic field (i.e. the first membrane 110 may be actuated by the electrostatic force), but not limited thereto.

In this embodiment, the first membrane 110 and the first actuator 120 may be configured to perform an acoustic transformation. That is to say, the acoustic wave is produced due to the movement of the first membrane 110 actuated by the first actuator 120, and the movement of the first membrane 110 is related to a sound pressure level (SPL) of the acoustic wave.

The first actuator 120 may actuate the first membrane 110 to produce the acoustic wave based on received driving signal(s). The acoustic wave is corresponding to an input audio signal, and the driving signal is corresponding to (related to) the input audio signal.

In some embodiments, the acoustic wave, the input audio signal and the driving signal have the same frequency, but not limited thereto. That is to say, the acoustic transducer 100 produces a sound at the frequency of sound (i.e., the acoustic transducer 100 generates the acoustic wave complying with the zero-mean-flow assumption of classic acoustic wave theorems), but not limited thereto.

As shown in FIG. 1 to FIG. 3, the film structure FS of the acoustic transducer 100 includes at least one slit 130, wherein the slit 130 may have a first sidewall S1 and a second sidewall S2 opposite to the first sidewall S1. In the present invention, an gap 130P of the slit 130 exists between the first sidewall S1 and the second sidewall S2 in a plane parallel to the direction X and the direction Y (i.e., the gap 130P of the slit 130 is parallel to the horizontal surface SH of the base BS), wherein the width of the gap 130P of the slit 130 may be designed based on requirement(s) (e.g., the width may be, but not limited to, around 1 μm). In the present invention, based on the driving signal received by the first actuator 120, the slit 130 may generate a vent 130T between the first sidewall S1 and the second sidewall S2 temporarily (i.e., the film structure FS is configured to be actuated to form a vent 130T temporarily), wherein the opening of vent 130T is in the direction Z, such the opening of vent 130T forms surfaces that are substantially perpendicular to the direction X and the direction Y. Note that, in the description and claims of the present application, "gap 130P" is in a plane parallel to the direction X and the direction Y, and shall refer to a space widthwise along the slit 130 (i.e., the space between the first sidewall S1 and the second sidewall S2 in the plane parallel to the direction X and the direction Y); "vent 130T" shall refer to a space between the first sidewall S1 and the second sidewall S2 in the direction Z (the normal direction of the horizontal surface SH of the base BS) perpendicular to the direction X and the direction Y.

The slit 130 may be any suitable type as long as it can generate a vent 130T between the first sidewall S1 and the second sidewall S2 based on the driving signal received by the first actuator 120.

The slit 130 may be disposed at any suitable position. In this embodiment, as shown in FIG. 1, the first membrane 110 may have the slit 130 (i.e., the slit 130 is a cut through the first membrane 110, so as to be formed within the first membrane 110), such that the first membrane 110 may include the first sidewall S1 and the second sidewall S2 of the slit 130, but not limited thereto. Namely, in this embodiment, the first membrane 110 performing the acoustic transformation may be configured to be actuated to form the vent 130T, and the vent 130T is formed because of the slit 130.

In another embodiment (e.g., FIG. 10), the slit 130 may be a boundary of the first membrane 110, such that the first membrane 110 may include the first sidewall S1 of the slit 130 and not include the second sidewall S2 of the slit 130, and the first sidewall S1 of the slit 130 may be one of the outer edges 110*e* of the first membrane 110, but not limited thereto.

In the present invention, the number of the slit(s) 130 included in the acoustic transducer 100 may be adjusted based on requirement(s). For instance, as shown in FIG. 1, the acoustic transducer 100 may include four slits 130*a*, 130*b*, 130*c* and 130*d*, such that the first membrane 110 may include four membrane portions 112*a*, 112*b*, 112*c* and 112*d* divided by the slits 130*a*, 130*b*, 130*c* and 130*d* (i.e., each slit 130 divides the first membrane 110 into two membrane portions), but not limited thereto. In FIG. 1, the membrane portion 112*a* is between the slits 130*a* and 130*d*, the membrane portion 112*b* is between the slits 130*a* and 130*b*, and so on and so forth. Correspondingly, the first actuator 120 includes four actuating portions 120*a*, 120*b*, 120*c* and 120*d* disposed on the membrane portions 112*a*, 112*b*, 112*c* and 112*d*, respectively.

Therefore, the first sidewall S1 and second sidewall S2 of the slit 130 may respectively belong to different membrane portions of the first membrane 110. Taking the slit 130*a* as an example, the slit 130*a* is formed between the membrane portions 112*a* and 112*b*, such that the first sidewall S1 and second sidewall S2 of the slit 130*a* respectively belong to the membrane portions 112*a* and 112*b*. In other words, the membrane portion 112*a* and the actuating portion 120*a* are at one side of the slit 130*a*, and the membrane portion 112*b* and the actuating portion 120*b* are at another side of the slit 130*a*. For instance, a point C is on the first sidewall S1 of the slit 130*a*, and a point D is on the second sidewall S2 of the slit 130*a*, such that the point C and the point D respectively belong to membrane portions 112*a* and 112*b* and form a pair of points separated by the gap 130P of the slit 130*a*.

In the present invention, the shape/pattern of the slit 130 is not limited. For example, the slit 130 may be a straight slit, a curved slit, a combination of straight slits, a combination of curved slits or a combination of straight slit(s) and curved slit(s). In this embodiment, as shown in FIG. 1 and FIG. 2, the slit 130 may be a curved slit, but not limited thereto. In this embodiment, as shown in FIG. 1 and FIG. 2, the slit 130 may extend toward a central portion of the first membrane 110 e.g., from a corner 110R of the first membrane 110. In this embodiment, a curvature of the slit 130 may increase as the slit 130 extending from the corner 110R of the first membrane 110 toward the central portion of the first membrane 110, such that the slit 130 may form as a hook pattern, but not limited thereto. Specifically, taking the slit 130*a* as an example, a first radius of curvature at a point A on the slit 130*a* is smaller than a second radius of curvature at a point B on the slit 130*a*, where the point A is farther away from the corner 110R compared to the point B (i.e., a first length along the slit 130*a* between the point A and the corner 110R is larger than a second length along the slit 130*a* between the point B and the corner 110R), but not limited thereto. Moreover, as shown in FIG. 1, the slits 130 may extend inward on the first membrane 110 and form a vortex pattern, but not limited thereto.

In another aspect, as illustrated in FIG. 3, the slit 130 may divide the first membrane 110 (the film structure FS) into two flaps opposite to each other. Namely, two membrane portions of the first membrane 110 divided by the slit 130 may be a first flap and a second flap respectively, such that the first sidewall S1 may belong to the first flap, and the second sidewall S2 may belong to the second flap. The first flap may include a first end and a second end (also referred as a free end), the first end may be anchored by one anchor structure 140, and the second end (i.e., the free end) may be configured to perform a first up-and-down movement (i.e., the second end of the first flap may move upwardly and downwardly) to form the vent 130T. The second flap may include a first end and a second end (also referred as a free end), the first end may be anchored by one anchor structure 140, and the second end (i.e., the free end) may be configured to perform a second up-and-down movement (i.e., the second end of the second flap may move upwardly and downwardly) to form the vent 130T. The movement of the free end of the second flap may be different from (e.g., in the embodiment of FIG. 4) or opposite to (e.g., in the embodiment of FIG. 8) the movement of the free end of the first flap.

Taking the slit 130*a* formed between the membrane portions 112*a* and 112*b* in FIG. 1 as an example, the first sidewall S1 of the slit 130*a* may be on the free end of the first flap (i.e., the point C may be on the second end of the first flap), and the second sidewall S2 of the slit 130*a* may be on the free end of the second flap (i.e., the point D may be on the second end of the second flap), but not limited thereto.

Moreover, the slit 130 may release the residual stress of the first membrane 110, wherein the residual stress is generated during the manufacturing process of the first membrane 110 or originally exist in the first membrane 110.

As shown in FIG. 1 and FIG. 2, because of the arrangement of the slits 130, the first membrane 110 may optionally include a coupling plate 114 connected to the membrane portions 112*a*, 112*b*, 112*c* and 112*d*. In this embodiment, all membrane portions 112*a*, 112*b*, 112*c* and 112*d* are connected to the coupling plate 114, and the coupling plate 114 surrounded by the membrane portions 112*a*, 112*b*, 112*c* and 112*d* (i.e., the coupling plate 114 is the central portion of the first membrane 110) and/or the slits 130, but not limited thereto. For instance, the coupling plate 114 is only connected to the membrane portions 112*a*, 112*b*, 112*c* and 112*d*, but not limited thereto. For instance, in FIG. 1, the first actuator 120 may not overlap the coupling plate 114 in the direction Z (the normal direction of the horizontal surface SH of the base BS), but not limited thereto. In this embodiment, since the coupling plate 114 exists, even if the structural strength of the first membrane 110 is weakened due to the formation of the slit 130, the breaking possibility of the first membrane 110 may be decreased and/or the break of the first membrane 110 may be prevented during the manufacture. In other words, the coupling plate 114 may maintain the structural strength of the first membrane 110 in a certain level.

Owing to the existence of the slit(s) 130, it may be considered that the first membrane 110 includes a plurality of spring structures which are formed because of the slit(s) 130. In FIG. 1 and FIG. 2, the spring structure is considered to be connected between the coupling plate 114 and a part of the first membrane 110 overlapping the first actuator 120. Because of the existence of the spring structure, the displacement of the first membrane 110 may be increased and/or the first membrane 110 may deform elastically during the operation of the acoustic transducer 100.

In this embodiment, the acoustic transducer 100 may optionally include a chip disposed on the horizontal surface SH of the base BS, wherein the chip may include the film structure FS (including the first membrane 110 and the slit(s) 130), the anchor structure(s) 140 and the first actuator 120 at least. The manufacturing method of the chip is not limited. For example, in this embodiment, the chip may be formed by at least one semiconductor process to be a MEMS (Micro Electro Mechanical System) chip, but not limited thereto.

Note that the first membrane 110, the slit(s) 130, the first actuator 120 and the anchor structure 140 of the present invention may be considered as a first unit U1.

As shown in FIG. 3, the acoustic transducer 100 is disposed within a housing structure HSS inside the wearable sound device. In FIG. 3, the housing structure HSS may have a first housing opening HO1 and a second housing opening HO2, wherein the first housing opening HO1 may be connected to an ear canal of a wearable sound device user, the second housing opening HO2 may be connected to an ambient of the wearable sound device, and the film structure FS is between the first housing opening HO1 and the second housing opening HO2. Note that the ambient of the wearable sound device may not inside the ear canal (e.g., the ambient of the wearable sound device may be directly connected to the space outside the ear). Furthermore, in FIG. 3, since the first chamber CB1 may exist between the base BS and the first membrane 110 (the film structure FS), the first chamber CB1 may be connected to the ambient of the wearable sound device through the back vent BVT of the base BS and the second housing opening HO2 of the housing structure HSS.

As shown in FIG. 3, the first membrane 110 (the film structure FS including the first flap and the second flap) may partition a space formed within the housing structure HSS into a first volume VL1 to be connected to the ear canal of the wearable sound device user and a second volume VL2 to be connected to the ambient of the wearable sound device. Thus, when the vent 130T is temporarily formed between the first sidewall S1 (i.e., the free/second end of the first flap) and the second sidewall S2 (i.e., the free/second end of the second flap) of the slit 130 in the direction Z (the normal direction of the horizontal surface SH of the base BS) by the actuation of the first actuator 120, the first volume VL1 is to be connected to the second volume VL2 through the vent 130T, such that the ambient of the wearable sound device and the ear canal of the wearable sound device user are connected to each other. That is to say, the ambient of the wearable sound device and the ear canal are to be connected via the temporarily opened vent 130T when the first membrane 110 is actuated. On the contrary, when the vent 130T is not formed between the first sidewall S1 (i.e., the free/second end of the first flap) and the second sidewall S2 (i.e., the free/second end of the second flap) of the slit 130 in the direction Z, the first volume VL1 is substantially disconnected from the second volume VL2, such that the ambient of the wearable sound device and the ear canal of the wearable sound device user are substantially separated from each other. That is to say, the ambient of the wearable sound device and the ear canal of the wearable sound device user are substantially separated (isolated) from each other when the vent 130T is not formed and/or the vent 130T is closed.

The condition "the vent 130T is closed" means the first sidewall S1 of the slit 130 in the FIG. 3, (i.e. the free/second end of the first flap) overlaps partially or fully with the second sidewall S2 of the slit 130 in the FIG. 3 (i.e. the free/second end of the second flap) in the horizontal direction, and the condition "the vent 130T is opened", or equivalently "the vent 130T is formed", means that the first sidewall S1 of the slit 130 in the FIG. 3, (i.e. the free/second end of the first flap) does not overlap with the second sidewall S2 of the slit 130 in the FIG. 3 (i.e. the free/second end of the second flap) in the horizontal direction. Note that the heights of first sidewall S1 and the second sidewall S2 are defined by the thickness of the first membrane 110.

In FIG. 3, the first volume VL1 is connected to the first housing opening HO1 of the housing structure HSS, and the second volume VL2 is connected to the second housing opening HO2 of the housing structure HSS. Thus, the first volume VL1 is to be connected to the ear canal of the wearable sound device user through the first housing opening HO1, and the second volume VL2 is to be connected to the ambient of the wearable sound device through the second housing opening HO2. Note that the first chamber CB1 is a portion of the second volume VL2.

Figure 4:
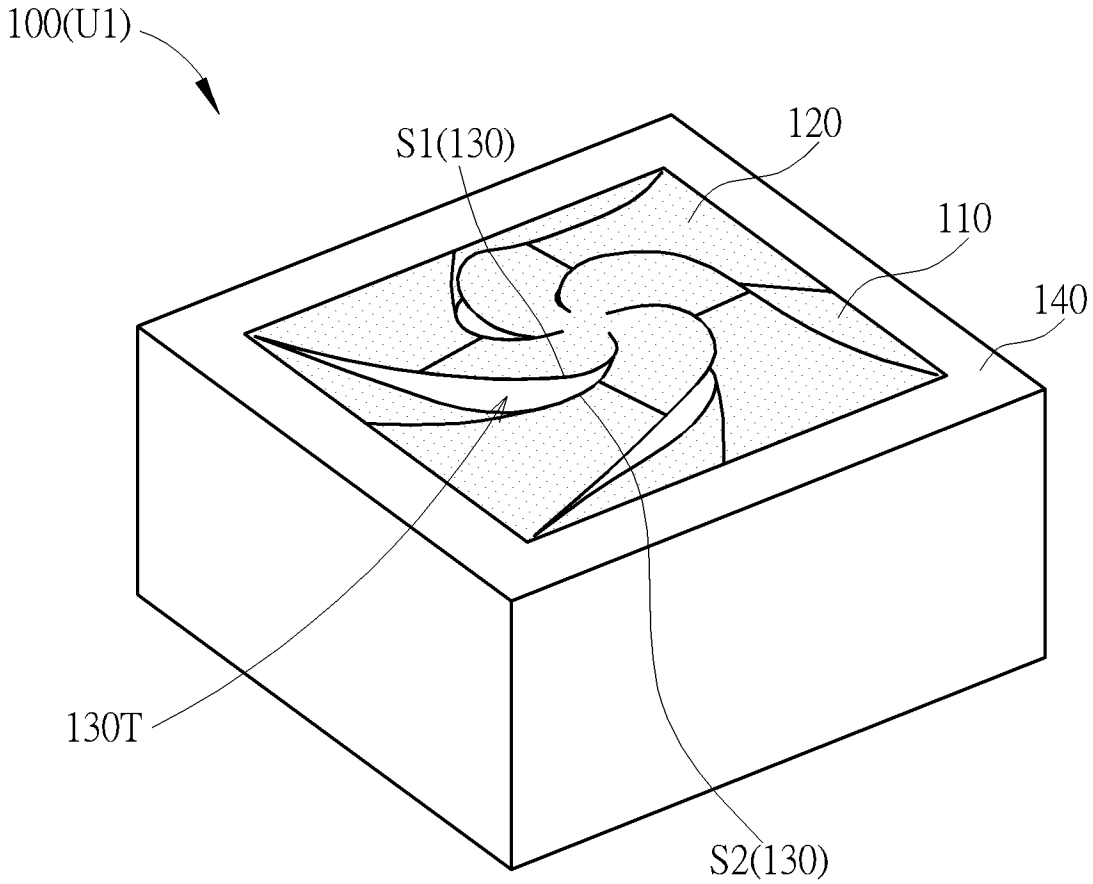
FIG. 4 is a schematic diagram illustrating a first membrane in a first mode according to the first embodiment of the present invention.

Further referring to FIG. 4, FIG. 4 is a schematic diagram illustrating a first membrane in a first mode according to the first embodiment of the present invention. As shown in FIG. 2 and FIG. 4, when the first membrane 110 is actuated, the first membrane 110 deforms into a deformed type 110Df. In the present invention, the acoustic transducer 100 may include a first mode and a second mode, wherein the first actuator 120 receives first driving signal(s) in the first mode to generate a vent 130T formed between the first sidewall S1 (i.e., the free/second end of the first flap) and the second sidewall S2 (i.e., the free/second end of the second flap) of the slit 130 in the direction Z (the normal direction of the horizontal surface SH of the base BS), and the first actuator 120 receives second driving signal(s) in the second mode to not generate the vent 130T between the first sidewall S1 and the second sidewall S2 of the slit 130 in the direction Z.

As shown in FIG. 4, in the first mode, the first sidewall S1 and the second sidewall S2 of the slit 130 may have different displacements, causing the overlapping across the gap 130P of slit 103 between the first sidewall S1 and the second sidewall S2 to change. When the difference between these displacements in direction Z is greater than the thickness of the first membrane 110, the first sidewall S1 is no longer overlapped with the second sidewall S2, an opening between the first sidewall S1 and the second sidewall S2 is formed and the vent 130T is said to be opened. Taking the points C and Don the two side of slit 130*a* of FIG. 1 as an example, when the first membrane 110 is actuated in the first mode, point C of the first sidewall S1 on the membrane portion 112*a* is actuated according to the first driving signal (e.g., a voltage) to have a first displacement Uz_a along the direction Z, point D on the second sidewall S2 on the membrane portion 112*b* is actuated according to the first driving signal to have a second displacement Uz_b along the direction Z, and the first displacement Uz_a of point C is significantly larger than the second displacement Uz_b of pint D, such that the segment of the first sidewall S1 near point C and the segment of the second sidewall S2 near point D become non-overlapping and the vent 130T is formed (or "opened"). The opening size $U_{ZO}$ of the vent 130T is determined by a membrane displacement difference ΔUz, between the first displacement Uz_a and the second displacement Uz_b, and the thickness of the first membrane 110: $U_{ZO}$=ΔUz−T110, where ΔUz=|Uz_a−Uz_b|, T110 is the thickness of the first membrane 110 and T110 may be 5-7 μm in practice, but not limited thereto. When the membrane displacement difference ΔUz is larger than the thickness T110 of the first membrane 110 (the film structure FS) in the first mode, it is said that the vent 130T will be "temporarily opened". The larger is opening size $U_{ZO}$ of the vent 130T, the wider will the vent 130T opens.

When the vent 130T is temporarily opened, as illustrated in FIG. 4, the air may start to flow between the volumes (i.e., the first volume VL1 and the second volume VL2) due to the pressure difference between the two sides of the first membrane 110, such that the pressure caused by the occlusion effect may be released (i.e., the pressure difference between the ear canal and the ambient of the wearable sound device may be released through the airflow flowing through the vent 130T), so as to suppress the occlusion effect.

Rationale of forming the vent 130T is described below. Refer to points C and D of the slit 130*a* illustrated in FIG. 1. The point C is located on the first sidewall S1 on the membrane portion 112*a*, the point D is located on the second sidewall S2 on the membrane portion 112*b*, and the point D is opposite to the point C, across the gap 130P of the slit 130. The displacement of the membrane portion 112*a* at the point C is driven by the actuating portion 120*a*, and the displacement of the membrane portion 112*b* at the point D is driven by the actuating portion 120*b*. A distance DC from the point C to an anchor edge of the membrane portion 112*a* is longer than a distance DD from the point D to an anchor edge of the membrane portion 112*b*. Since less distance implies higher stiffness, deformation at the point D would be less than deformation of the point C, even applying the same driving force. In addition, the arrow DC overlaps with the region of the actuating portion while the arrow DD does not, which implies that the driving force applied by the actuating portion 120*a* at the point C is stronger than which applied by the actuating portion 120*b* at the point D. Combining those factors, the displacement of the membrane portion 112*a* at the point C, where driving force strength is stronger while stiffness is lower, would be larger than the displacement of the membrane portion 112*b* at the point D.

Figure 5:
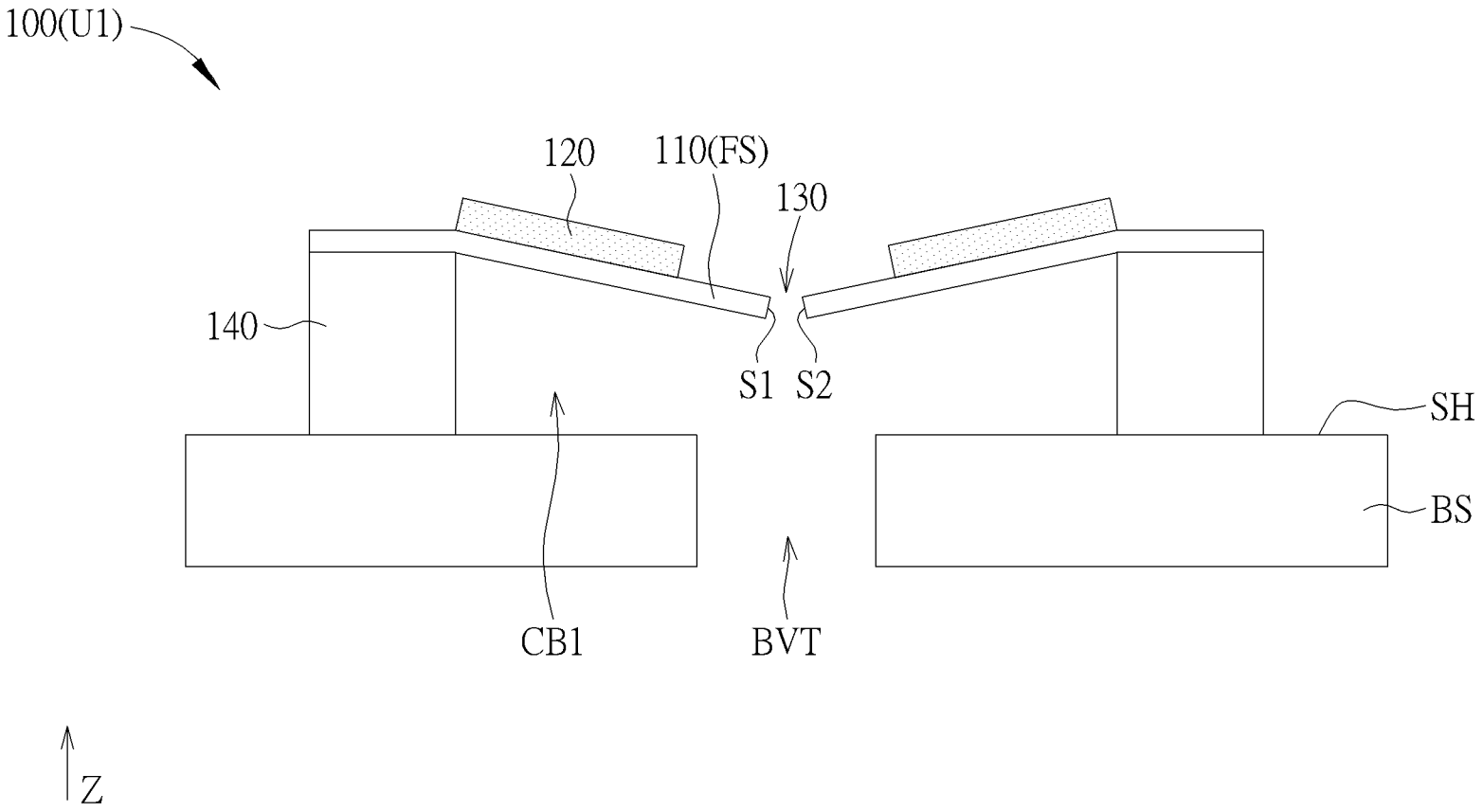
FIG. 5 is a schematic diagram of a cross sectional view illustrating a first membrane in a second mode according to another embodiment of the present invention.

In the second mode, the membrane displacement difference is less than the thickness of the first membrane 110, namely ΔUz≤T110, in other words, the sidewall at point C of the first sidewall S1 and the sidewall at point D of the second sidewall S2 may partially or fully overlap in the horizontal direction. For example, two membrane portions related to the slit 130 (i.e., the first flap and the second flap) in the second mode are shown in FIG. 3, these two membrane portions (two flaps) may be substantially parallel to each other and be substantially parallel to the horizontal surface SH of the base BS, but not limited thereto. In another example, two membrane portions related to the slit 130 (e.g., the first flap and the second flap) in the second mode are shown in FIG. 5, these two membrane portions (two flaps) may not be parallel to the horizontal surface SH of the base BS, the free/second end of the first flap (the first sidewall S1) may be closer to the base BS than the anchored/first end of the first flap, and the free/second end of the second flap (the second sidewall S2) may be closer to the base BS than the anchored/first end of the second flap, but not limited thereto, and ΔUz≤T110. Thus, in either case where the slit 130 and its associated membrane portions is in the second mode, namely ΔUz≤T110, the vent 130T is not opened/generated, and/or the vent 130T is closed.

The width of the gap 130P of the slit 130 should be sufficiently small, e.g., 1 μm~2 μm in practice. Airflow through narrow channels can be highly damped due to viscous forces/resistance along the walls of the airflow pathways, known as boundary layer effect within field of fluid mechanics. So, the airflow through the gap 130P of the slit 130 in the second mode may be much smaller compared to the airflow through the vent 130T of the slit 130 in the first mode (e.g., the airflow through the gap 130P of the slit 130 in the second mode may be negligible or 10 times lower than the airflow through the vent 130T of the slit 130 in the first mode). In other words, the width of the gap 130P of the slit 130 is sufficiently small such that, the airflow/leakage through the gap 130P of the slit 130 in the second mode is negligible compared to (e.g., less than 10% of) the airflow through the vent 130T in the first mode.

According to the above, in the first mode and the second mode, the first sidewall S1 serving as the free/second end of the first flap may perform the first up-and-down movement, and the second sidewall S2 serving as the free/second end of the second flap may perform the second up-and-down movement. In particular, as shown in FIG. 3 to FIG. 5, when the first sidewall S1 (the free/second end of the first flap) performs the first up-and-down movement, the first sidewall S1 makes no physical contact with any other component within the acoustic transducer 100; when the second sidewall S2 (the free/second end of the second flap) performs the second up-and-down movement, the second sidewall S2 makes no physical contact with any other component within the acoustic transducer 100.

Figure 6:
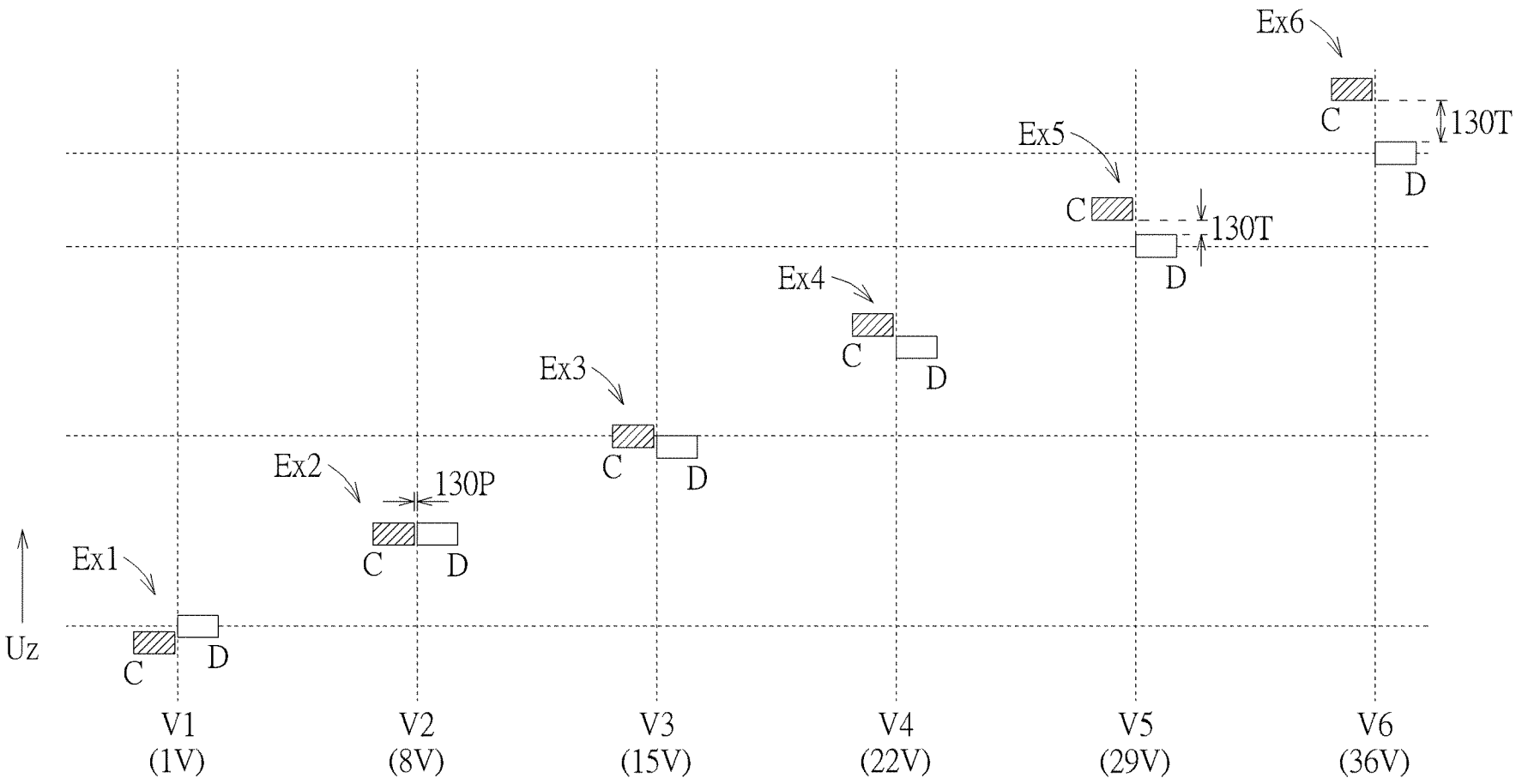
FIG. 6 is a schematic diagram illustrating multiple examples of relative position pairs on different sides of a slit according to the first embodiment of the present invention.
Figure 7:
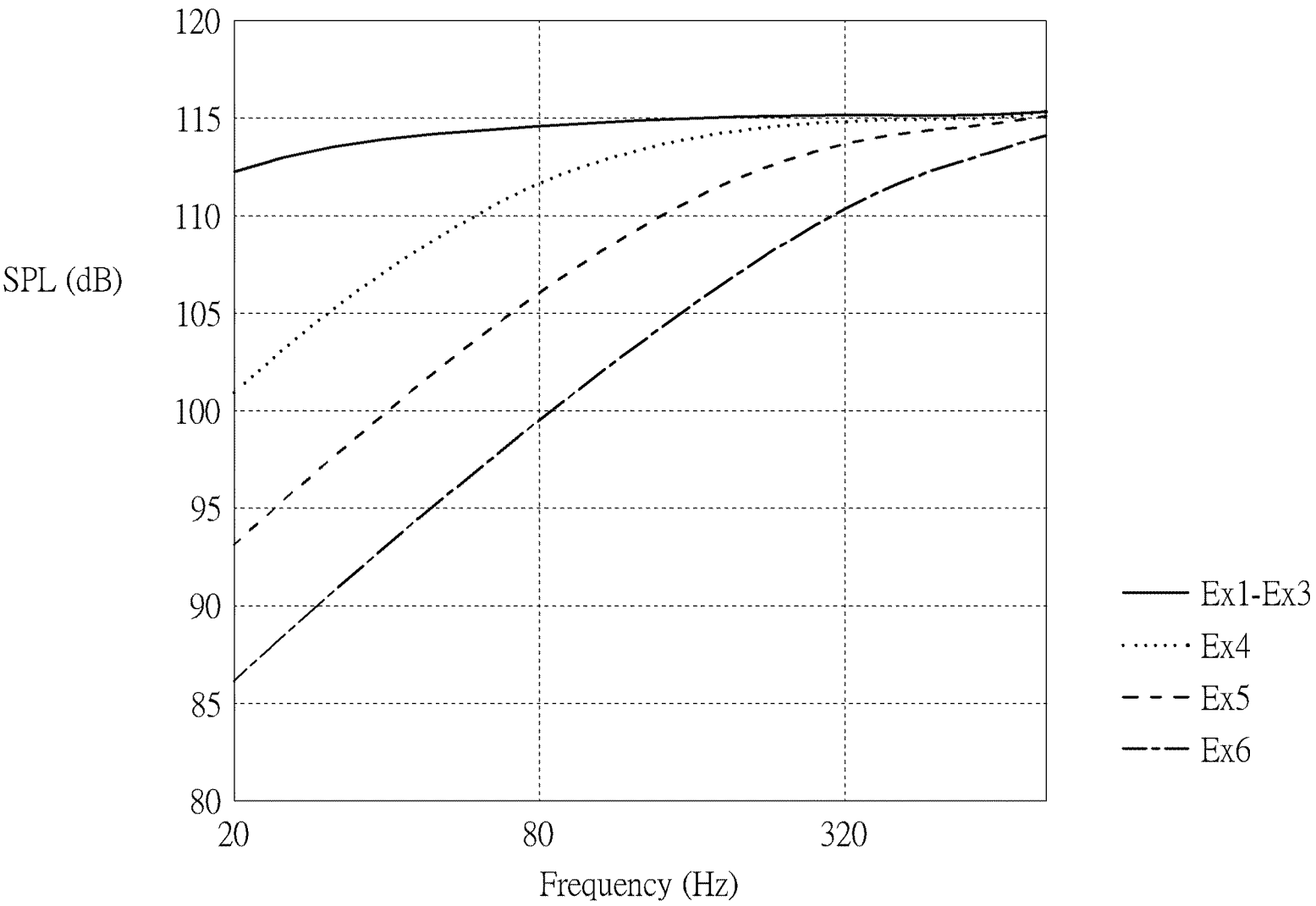
FIG. 7 is a schematic diagram illustrating frequency responses of multiple examples according to the first embodiment of the present invention.

Referring to FIG. 6 and FIG. 7, FIG. 6 is a schematic diagram illustrating multiple examples of relative position pairs on different sides of a slit according to the first embodiment of the present invention, and FIG. 7 is a schematic diagram illustrating frequency responses of multiple examples according to the first embodiment of the present invention. FIG. 6 illustrates six examples Ex1-Ex6 of relative position pairs of the point C (or a free/second end) on the membrane portion 112*a* (or a first flap) and the point D (or a free/second end) on the membrane portion 112*b* (or a second flap), corresponding to six progressively higher actuator driving voltage V1-V6, as labeled on the horizontal axis of FIG. 6. Vertical axis of FIG. 6 represents displacements (Uz) of the point C and the point D in the direction Z. Note that the height of blocks representing the points C and D shown in FIG. 6 corresponds to the thickness of the first membrane 110. FIG. 7 illustrates the frequency responses of the acoustic transducer 100 when the first membrane 110 actuated by the driving voltage V1-V6 (examples Ex1-Ex6) shown in FIG. 6. Note that, the numerical values shown in FIG. 6 and FIG. 7 are for illustrative purpose, practical applied voltage may be adjusted according to practical circumstance.

As shown in FIG. 4 and FIG. 6, in this case (a first driving method), the point C of the first sidewall S1 (i.e., the second end of the first flap) and the point D of the second sidewall S2 (i.e. the second end of the second flap) of the slit 130 moves in the same direction, i.e., both the first sidewall S1 and the second sidewall S2 moves upward in the positive direction Z as the voltage applied to the first actuator 120 increases, and the voltage is raised above a threshold voltage, such as to voltage V5 or V6, to generate/open the vent 130T; inversely, both the first sidewall S1 and the second sidewall S2 moves downward in the positive direction Z as the voltage applied to the first actuator 120 decrease, and the voltage is lowered below a threshold voltage, such as to V1~V3, to close the vent 130T.

As shown in FIG. 6, the point C is lower the point D when the voltage V1 (e.g., 1V) is applied on the first actuator 120; the point C is substantially aligned to the point D when the voltage V2 (e.g., 8V) is applied on the first actuator 120; the point C is higher than the point D by exactly the thickness of the first membrane 110 when the threshold voltage V4 (e.g., 22V) is applied on the first actuator 120; and the point C is higher than the point D by more than the thickness of the first membrane 110 when the voltages V5-V6 is applied on the first actuator 120. Therefore, in FIG. 6, when the first actuator 120 receives the voltage higher than the threshold voltage V4, such as voltage V5~V6, the vent 130T is created, where the vent 130T will be opened; and conversely, when the first actuator 120 receives the voltage lower than the threshold voltage V4, such as voltage V1~V3, the vent 130T will not be created, and the vent 130T is said to be closed.

In other words, the membrane portion 112*a* at point C is partially below the membrane portion 112*b* at point D when the voltage V1 is applied on the first actuator 120. The membrane portion 112*a* at point C is substantially aligned to the membrane portion 112*b* at point D, in the horizontal direction, when the voltage V2 is applied on the first actuator 120. The membrane portion 112*a* at point C is partially above the membrane portion 112*b* at point D when the voltage V3 is applied on the first actuator 120. The lower edge of the membrane portion 112*a* at point C is substantially aligned to the top edge of the membrane portion 112*b* at point D, in the horizontal direction, when the voltage V4 is applied on the first actuator 120. The membrane portion 112*a* at point C is completely above the membrane portion 112*b* at point D, in the direction Z, when a voltage greater than the threshold voltage V4, such as the voltage V5 or V6, is applied on the first actuator 120, such that the vent 130T is generated and opened.

As shown in FIG. 6, in this embodiment, the voltage V5 or V6 is applied on the first actuator 120 in the first mode, and the voltage V1, V2 or V3 is applied on the first actuator 120 in the second mode. In other words, an absolute value of the first driving signal applied on the first actuator 120 in the first mode may be greater than or equal to a threshold value, and an absolute value of the second driving signal applied on the first actuator 120 in the second mode may be less than the threshold value, wherein the threshold value is illustrated as voltage V4 (22V) in FIG. 6, but not limited thereto.

According to the above, in the second mode, the membrane portion 112*a* may be partially below, partially above or substantially aligned to the membrane portion 112*b*. That is to say, the first actuator 120 receives the second driving signal in the second mode to make the first sidewall S1 be corresponding to (or overlapping with) the second sidewall S2 in the horizontal direction parallel to the horizontal surface SH of the base BS (i.e., the vent 130T is closed and/or is not generated). In this embodiment, the entire first sidewall S1 is corresponding to the second sidewall S2 in the horizontal direction in the second mode.

On the other hand, in the first mode, the first actuator 120 receives the first driving signal to make at least a part of the first sidewall S1 be not corresponding to, or not overlapping with, the second sidewall S2 in the horizontal direction, such that the vent 130T is formed by the non-overlapping region between the first sidewall S1 and the second sidewall S2.

As shown in FIG. 7, since the width of the gap 130P of the slit 130 should be sufficiently small, in the frequency response of the acoustic transducer 100, the low frequency roll-off (LFRO) corner frequency of the SPL in the second mode is low, typically 35 Hz or lower. Conversely, when the vent 130T opens/exists in the first mode, the air will flow through the vent 130T with an airflow impedance inversely proportional to the opening size of the vent 130T, and therefore, in the frequency response of the acoustic transducer 100, the LFRO corner frequency in the first mode will be significantly higher than the LFRO corner frequency in the second mode. For instance, the LFRO corner frequency in the first mode may fall between 80 to 400 Hz, depends on the opening size of the vent 130T, but not limited thereto.

In the first driving method of the acoustic transducer 100, when the occlusion effect occurs, the first driving signal may be applied on the first actuator 120 to make the acoustic transducer 100 in the first mode, such that the vent 130T is generated/opened to allow the occlusion induced pressure to be released by the airflow through the vent 130T, so as to suppress the occlusion effect. For example, in this embodiment, the first driving signal may include a vent generating signal (e.g., the voltage V5 or V6) and a common signal (e.g., the common signal plus the vent generating signal), but not limited thereto. When the occlusion effect does not occur, the second driving signal may be applied on the first actuator 120 to make the acoustic transducer 100 in the second mode, such that the vent 130T is not generated. For example, in this embodiment, the second driving signal may include a vent restraining signal (e.g., the voltage V1, V2 or V3) and a common signal (e.g., the common signal plus the vent restraining signal), but not limited thereto.

The common signal may be designed based on requirement(s). In some embodiments, the common signal may include a constant (DC) bias voltage, an input audio (AC) signal or a combination thereof. For example, when the common signal includes the input audio signal, the common signal includes a signal corresponding to (related to) the value(s) of the input audio signal, such that the first membrane 110 may generate the acoustic wave while forming the vent 130T in the first mode, or alternatively, the first membrane 110 may generate the acoustic wave while restraining (close) the vent 130T. In an embodiment, the common signal may include a constant bias voltage, so as to maintain the first membrane 110 in a certain position. For example, the constant bias voltage, applied on the first actuator 120, may cause the first membrane 110 (e.g., the first flap and the second flap) to be substantially parallel to the horizontal surface SH of the base BS.

Note that, the embodiments and examples shown in FIG. 4 to FIG. 7 belong to the first driving method which the first sidewall S1 and the second sidewall S2 of the slit 130 moves in the same direction for generating/opening and closing the vent 130T. A second driving method for generating the vent 130T may involve making the first sidewall S1 and the second sidewall S2 move in the different directions, and a third driving method for generating the vent 130T may involve only the one of the sidewalls, such as the first sidewall S1, moves while the other sidewall, such as the second sidewall S2, is stationary.

Figure 8:
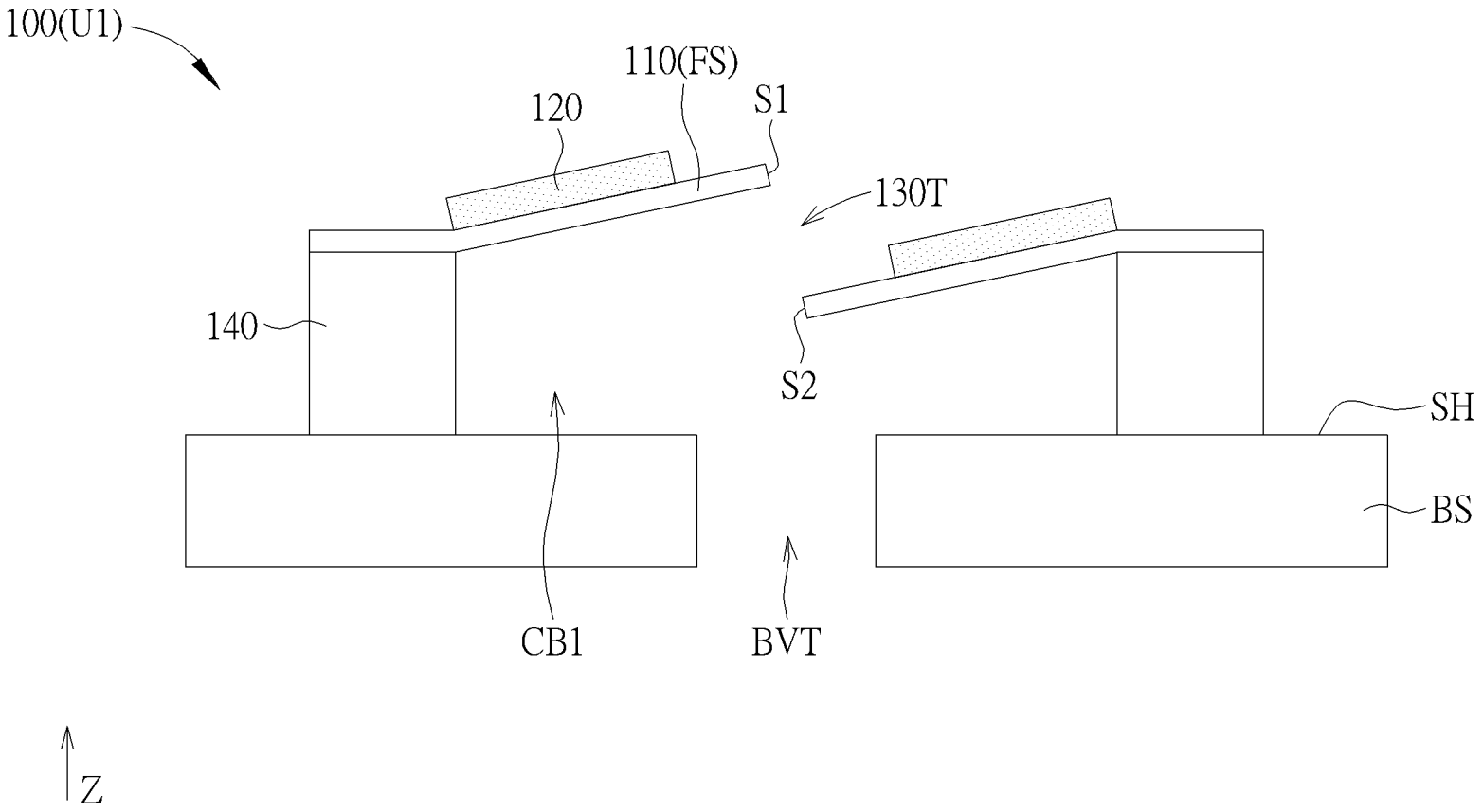
FIG. 8 is a schematic diagram of a cross sectional view illustrating a first membrane in a first mode according to another embodiment of the present invention.

Referring to FIG. 8, FIG. 8 is a schematic diagram of a cross sectional view illustrating a first membrane in a first mode according to another embodiment of the present invention, wherein FIG. 8 shows that the first membrane 110 of the acoustic transducer 100 is actuated in the first mode according to the second driving method. As shown in FIG. 8, regarding one slit 130, the first flap (one membrane portion containing the first sidewall S1 of the slit 130) may be actuated to move toward a first direction, and the second flap (one membrane portion containing the second sidewall S2 of the slit 130) may be actuated to move toward a second direction opposite to the first direction, such that the vent 130T is formed. Namely, the first up-and-down movement of the first sidewall S1 (the free/second end of the first flap) is opposite to the second up-and-down movement of the second sidewall S2 (the free/second end of the second flap). For example, the first direction and the second direction may be substantially parallel to the direction Z, and in transition from a second, such as the one illustrated in FIG. 3, to a first mode, such as the one shown in FIG. 8, the free/second end of the first flap (the first sidewall S1) may move upwards while the free/second end of the second flap (the second sidewall S2) may move downwards. Conversely, in transition from the first mode as shown in FIG. 8 back to the second mode as shown in FIG. 3, the free/second end of the first flap (the first sidewall S1) may move downwards, and the free/second end of the second flap (the second sidewall S2) may move upwards. In either transition discussed above, the first sidewall S1 of the first flap and the second sidewall S2 of the second flap move in opposite directions.

In addition, the free/second end of the first flap (the first sidewall S1) may be actuated to have a first displacement Uz_a toward the first direction, and the free/second end of the second flap (the second sidewall S2) may be actuated to have a second displacement Uz_b toward the second direction. In an embodiment, the first displacement of the first sidewall S1 and the second displacement of the second sidewall S2 may be of substantially equal in distance, but opposite in direction.

Furthermore, the first displacement of the first sidewall S1 and the second displacement of the second sidewall S2 may be temporarily symmetrical, i.e. the movements of the first sidewall S1 and the second sidewall S2 are substantially equal length wise, but opposite in direction over any period of time. When the movements of the first sidewall S1 and the second sidewall S2 of FIG. 8 is temporarily symmetrical, regarding one slit 130, a first air movement is produced because the first flap (one membrane portion containing the first sidewall S1 of the slit 130) is actuated to move toward the first direction, a direction of the first air movement is related to the first direction, a second air movement is produced because the second flap (one membrane portion containing the second sidewall S2 of the slit 130) is actuated to move toward the second direction opposite to the first direction, and a direction of the second air movement is related to the second direction. Since the first air movement and the second air movement may be respectively related to the opposite directions, at least a portion of the first air movement and at least a portion of the second air movement may cancel each other when the first flap (one membrane portion containing the first sidewall S1 of the slit 130) and the second flap (one membrane portion containing the second sidewall S2 of the slit 130) are simultaneously actuated to open/close the vent 130T.

In some embodiments, the first air movement and the second air movement may substantially cancel each other when the first flap and the second flap are simultaneously actuated to open/close the vent 130T (for example, the first displacement toward the first direction and the second displacement toward the second direction may be equal in distance but opposite in direction). Namely, a net air movement produced due to opening/closing the vent 130T, which contains the first air movement and the second air movement, is substantially zero. As the result, since the net air movement is substantially zero during the opening and/or closing operation of the vent 130T, the operations of the vent 130T produces no acoustic disturbance perceivable to the user of the acoustic transducer 100, and the opening and/or closing operation of the vent 130T is said to be "concealed".

In the embodiment related to FIG. 1, FIG. 2, FIG. 4, FIG. 6 and FIG. 7, one driving signal, refer to as the first driving method herein, is applied to the first actuator 120. In a second driving method, such as the driving signal for embodiment of FIG. 8, the driving signal applied on the actuating portion of the first actuator 120 on the first flap (the portion containing the first sidewall S1) may be different from the driving signal applied on the actuating portion of the first actuator 120 on the second flap (the portion containing the second sidewall S2). In detail, the first actuator 120 disposed on the first flap (the membrane portion containing the first sidewall S1) will receive the first signal, and the first actuator 120 disposed on the second flap (the membrane portion containing the second sidewall S2) will receive the second signal. Thus, the first flap will move according to the first signal, and the second flap will move according to the second signal.

The first signal and the second signal may contain component signals designed to make the first flap (the membrane portion containing the first sidewall S1) and the second flap (the membrane portion containing the second sidewall S2) to move in the opposite directions respectively. For example, the first signal may include a common signal plus an incremental voltage, and the second signal may include the same common signal plus a decremental voltage, wherein the incremental voltage may toggle between 0V and a positive voltage, such as 0V⇔10V, and the decremental voltage may change between 0V and a negative voltage, such as 0V⇔−10V, but not limited thereto. Note that the common signal may include the constant bias voltage, the input audio signal or a combination thereof, but not limited thereto.

For example, in the first mode of the acoustic transducer 100 in FIG. 8, the incremental voltage may have a positive voltage, e.g., 10V, making the first signal 10V higher than the common signal, and the decremental voltage may have a negative voltage, e.g., −10V, making the second signal 10V lower than the common signal and the vent 130T will be opened/formed when the delta displacement of the first membrane portion (containing the first sidewall S1) and the second membrane portion (containing the second sidewall S2) is greater than the thickness of the first membrane 110. Conversely, in the second mode of the acoustic transducer 100, both the incremental voltage of the first signal and the decremental voltage of the second signal may be approximately 0V, resulting in substantially the same driving signals being applied to the actuators on both portions of the first membrane 110, leading to both membrane portions (one containing the first sidewall S1, the other containing the second sidewall S2) producing approximately the same displacement and, as a result, the vent 130T will not be formed/opened, or, will be closed.

Therefore, under certain circumstance, the incremental voltage and the decremental voltage may be of substantially the same magnitude, but not limited thereto; under certain circumstance, such as in the first mode where the vent 130T is opened, the first signal may be higher than the second signal by a voltage level that is sufficient to cause delta displacement to be larger than the thickness of the membrane, but not limited thereto; under certain circumstances, such as in the second mode where the vent 130T is closed, the incremental voltage and the decremental voltage may both be or be close to 0V, but not limited thereto.

According to the above, the slit 130 of the present invention may be driven by the first driving method or the second driving method to serve as a dynamic front vent of the acoustic transducer 100, wherein the first volume VL1 and the second volume VL2 in the housing structure HSS are connected when the dynamic front vent is opened (i.e., the vent 130T of the slit 130 is opened and/or formed), and the first volume VL1 and the second volume VL2 in the housing structure HSS are separated from each other when the dynamic front vent is closed (i.e., the vent 130T of the slit 130 is closed and/or not formed). The wider is the vent 130T, the greater will be the dynamic front vent. Thus, the size of the front vent can be changed by the driving signal(s) based on requirement(s).

Moreover, the acoustic transducer 100 of the present invention may have the better water protection and the better dust protection due to the dynamic front vent.

In the present invention, the acoustic transducer 100 may use any suitable driver. For instance, the acoustic transducer 100 may use small driver (e.g., a typical 115 dB driver), such that the acoustic transducer 100 of the present invention may be suitable for the small size device.

Figure 9:
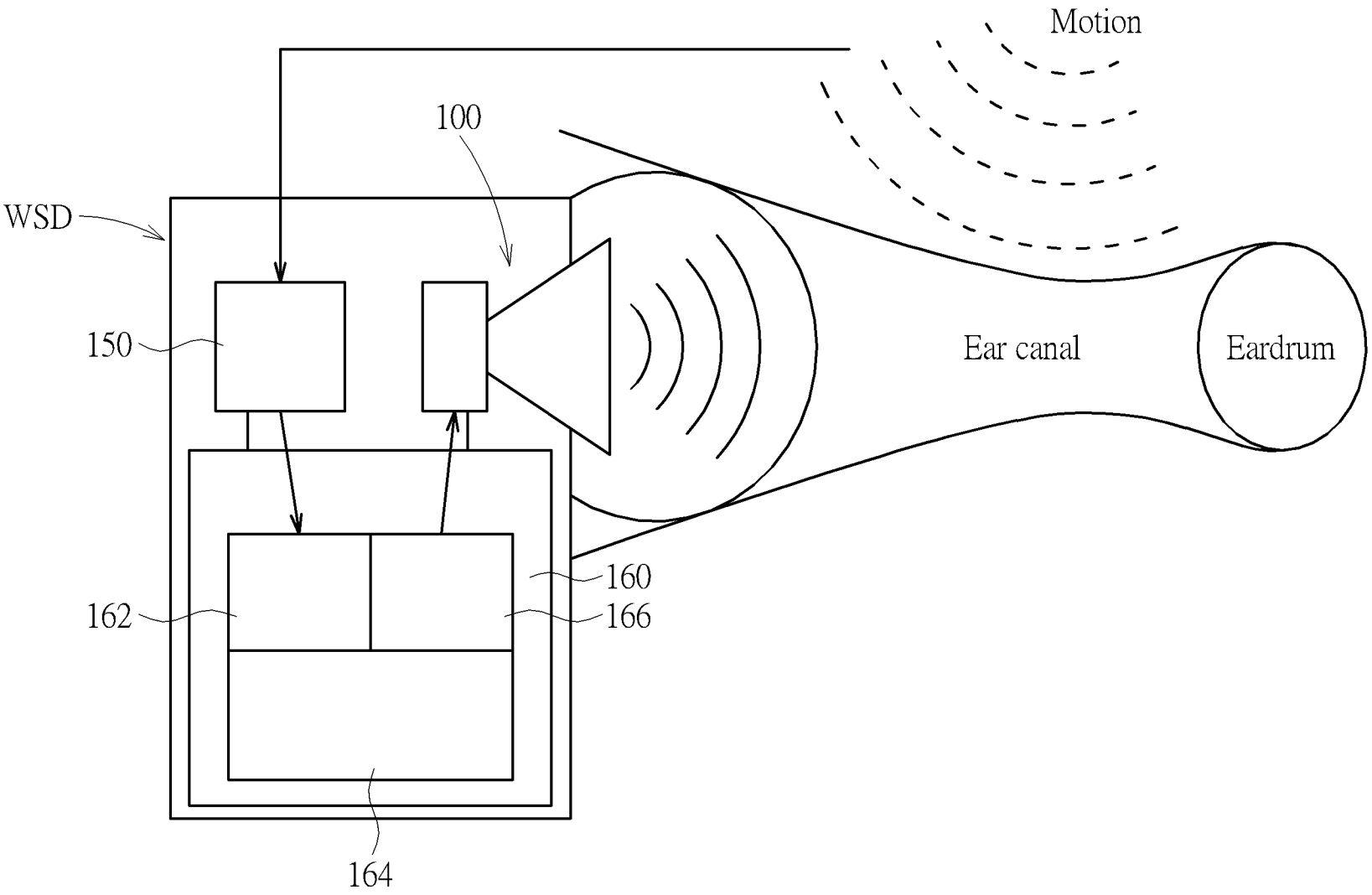
FIG. 9 is a schematic diagram illustrating a wearable sound device with an acoustic transducer according to an embodiment of the present invention.

Referring to FIG. 9, FIG. 9 is a schematic diagram illustrating a wearable sound device with an acoustic transducer according to an embodiment of the present invention. As shown in FIG. 9, the wearable sound device WSD may further include a sensing device 150 and a driving circuit 160 electrically connected to the sensing device 150 and the actuator (e.g., the first actuator 120) of the acoustic transducer 100.

The sensing device 150 may be configured to sense any required factor outside the wearable sound device WSD and corresponding to generate a sensing result. For example, the sensing device 150 may use an infrared (IR) sensing method, an optical sensing method, an ultrasonic sensing method, a capacitive sensing method or other suitable sensing method to sense any required factor, but not limited thereto.

In some embodiments, whether the vent 130T is formed is determined according to the sensing result. The vent 130T is opened (or formed) when a sensed quantity indicated by the sensing result crosses a certain threshold with a first polarity, and the vent 130T is closed (or not formed) when the sensed quantity crosses the certain threshold with a second polarity opposite to the first polarity. For instance, the first polarity may be from low to high, and the second polarity may be from high to low, such that the vent 130T is opened when the sensed quantity is changed from lower than the certain threshold to higher than the certain threshold, and the vent 130T is closed when the sensed quantity is changed from higher than the certain threshold to lower than the certain threshold, but not limited thereto.

Moreover, in some embodiments, a degree of opening of the vent 130T may be monotonically related to the sensed quantity indicated by the sensing result. Namely, the degree of opening of the vent 130T increases or decreases as the sensed quantity increases or decreases.

In some embodiments, the sensing device 150 may optionally include a motion sensor configured to detect a body motion of the user and/or a motion of the wearable sound device WSD. For example, the sensing device 150 may detect the body motion causing the occlusion effect, such as walking, jogging, talking, eating, etc. In some embodiments, the sensed quantity indicated by the sensing result represents the body motion of the user and/or the motion of the wearable sound device WSD, and the degree of opening of the vent 130T is correlated to the motion sensed. For instance, the degree of opening of the vent 130T increases as the motion increases.

In some embodiments, the sensing device 150 may optionally include a proximity sensor configured to sense a distance between an object and the proximity sensor. In some embodiments, the sensed quantity indicated by the sensing result represents the distance between the object and the proximity sensor, and the degree of opening of the vent 130T is correlated to the distance sensed. For instance, the vent 130T is opened (or formed) when this distance smaller than a predetermined distance, and the degree of opening of the vent 130T increases as this distance decreases. For instance, if the user wants to open (or form) the vent 130T, the user can use any suitable object (e.g., the hand) to approach the wearable sound device WSD, so as to make the proximity sensor sense this object to correspondingly generate the sensing result, thereby open/form the vent 130T.

In addition, the proximity sensor may further have a function for detecting that the user (predictably) taps or touches the wearable sound device WSD having the acoustic transducer 100 because these motions may also cause the occlusion effect.

In some embodiments, the sensing device 150 may optionally include a force sensor configured to sense the force applied on the force sensor of the wearable sound device WSD, the sensed quantity indicated by the sensing result represents the force pressing on the wearable sound device WSD, and the degree of opening of the vent 130T is correlated to the force sensed.

In some embodiments, the sensing device 150 may optionally include a light sensor configured to sense an ambient light of the wearable sound device WSD, the sensed quantity indicated by the sensing result represents the luminance of the ambient light sensed by the light sensor, and the degree of opening of the vent 130T is correlated to the luminance of the ambient light sensed.

The driving circuit 160 is configured to generate the driving signal(s) applied on the actuator (e.g., the first actuator 120), so as to actuate the first membrane 110, wherein the driving signal(s) may be based on the sensing result of the sensing device 150 and the value of the input audio signal. In FIG. 9, the driving circuit 160 may be an integrated circuit, but not limited thereto.

For example, in the first driving method, the first driving signal and the second driving signal may be generated by the driving circuit 160, and the vent generating signal of the first driving signal and the vent restraining signal of the second driving signal may be generated according to the sensing result, but not limited thereto.

For example, in the second driving method, the first signal and the second signal may be generated by the driving circuit 160, and the incremental voltage of the first signal and the decremental voltage of the second signal may be generated according to the sensing result, but not limited thereto.

Similarly, since the degree of opening of the vent 130T may be monotonically related to the sensed quantity indicated by the sensing result, the incremental voltage and/or the decremental voltage in the second driving method (or the vent generating signal in the first driving method) may have a monotonic relationship with the sensed quantity indicated by the sensing result.

Similarly, when the sensing device 150 includes the motion sensor, a magnitude of the incremental voltage and/or a magnitude of the decremental voltage in the second driving method (or the vent generating signal in the first driving method) may increase (or decrease) as the motion increases, but not limited thereto. Similarly, when the sensing device 150 includes the proximity sensor, a magnitude of the incremental voltage and/or a magnitude of the decremental voltage in the second driving method (or the vent generating signal in the first driving method) may increase (or decrease) as the distance decreases or decreases below a threshold, but not limited thereto. Similarly, when the sensing device 150 includes the force sensor, a magnitude of the incremental voltage and/or a magnitude of the decremental voltage in the second driving method (or the vent generating signal in the first driving method) may increase (or decrease) as the force increases, but not limited thereto. Similarly, when the sensing device 150 includes the light sensor, a magnitude of the incremental voltage and/or a magnitude of the decremental voltage in the second driving method (or the vent generating signal in the first driving method) may increase (or decrease) as the luminance of the ambient light decreases, but not limited thereto.

In addition, the driving circuit 160 may include any suitable component. For example, the driving circuit 160 may include an analog-to-digital converter (ADC) 162, a digital signal processing (DSP) unit 164, a digital-to-analog converter (DAC) 166, any other suitable component (e.g., a microphone detecting the SPL of the environmental sound or the SPL of the occlusion noise) or a combination thereof.

In this embodiment, based on the sensing result generated by the sensing device, the driving circuit 160 may correspondingly apply the driving signal(s) on the first actuator 120, so as to make the acoustic transducer 100 in the first mode or in the second mode. In the first mode, the acoustic transducer 100 forms the vent 130T, so as to suppress the occlusion effect. Also, the acoustic transducer 100 in the first mode may optionally generate the acoustic wave. In second mode, the acoustic transducer 100 generates the acoustic wave.

Optionally, the driving circuit 160 may further include a frequency response equalizer configured to adjust the driving signal of the acoustic transducer 100 in a specific frequency range. As shown in FIG. 7, four different LFRO corner frequencies in the frequency response of the acoustic transducer 100 corresponding to four different vent 130T conditions are shown. In an embodiment, a signal processing unit containing the frequency response equalizer may be configured to compensate for the differing LFRO corner frequency of the frequency response of the acoustic transducer 100 due to differing degree of opening of vent 130T. For example, the frequency response equalizer may be enabled to compensate for the LFRO frequency response curve of the example Ex5 (or Ex6) when the driving voltage V5 (or V6) is applied to the first actuator 120 and the vent 130T is opened as depicted in FIG. 6. In other words, the frequency response equalizer may be enabled in the first mode (the frequency response equalizer is enabled when the vent 130T is opened), and the frequency response equalizer may be disabled in the second mode (the frequency response equalizer is disabled when the vent 130T is closed). Furthermore, the amount of equalization generated by the frequency response equalizer may be adaptive, varying dynamically according to the opening size of the vent 130T. As the result, the frequency response equalizer may compensate for the varying LFRO of the low-frequency response of the acoustic transducer 100 due to the vent 130T being opened (i.e., the frequency response equalizer may compensate for the degradation of the low-frequency response of the acoustic transducer 100 in the first mode), such that the change in the frequency response of the acoustic transducer 100 may be equalized, the disruption of the sound production characteristics of the acoustic transducer 100 is minimized, and the listener's audio listening experience optimized.

The acoustic transducer of the present invention is not limited by the above embodiment(s). Other embodiments of the present invention are described below. For ease of comparison, same components will be labeled with the same symbol in the following. The following descriptions relate the differences between each of the embodiments, and repeated parts will not be redundantly described.

Figure 10:
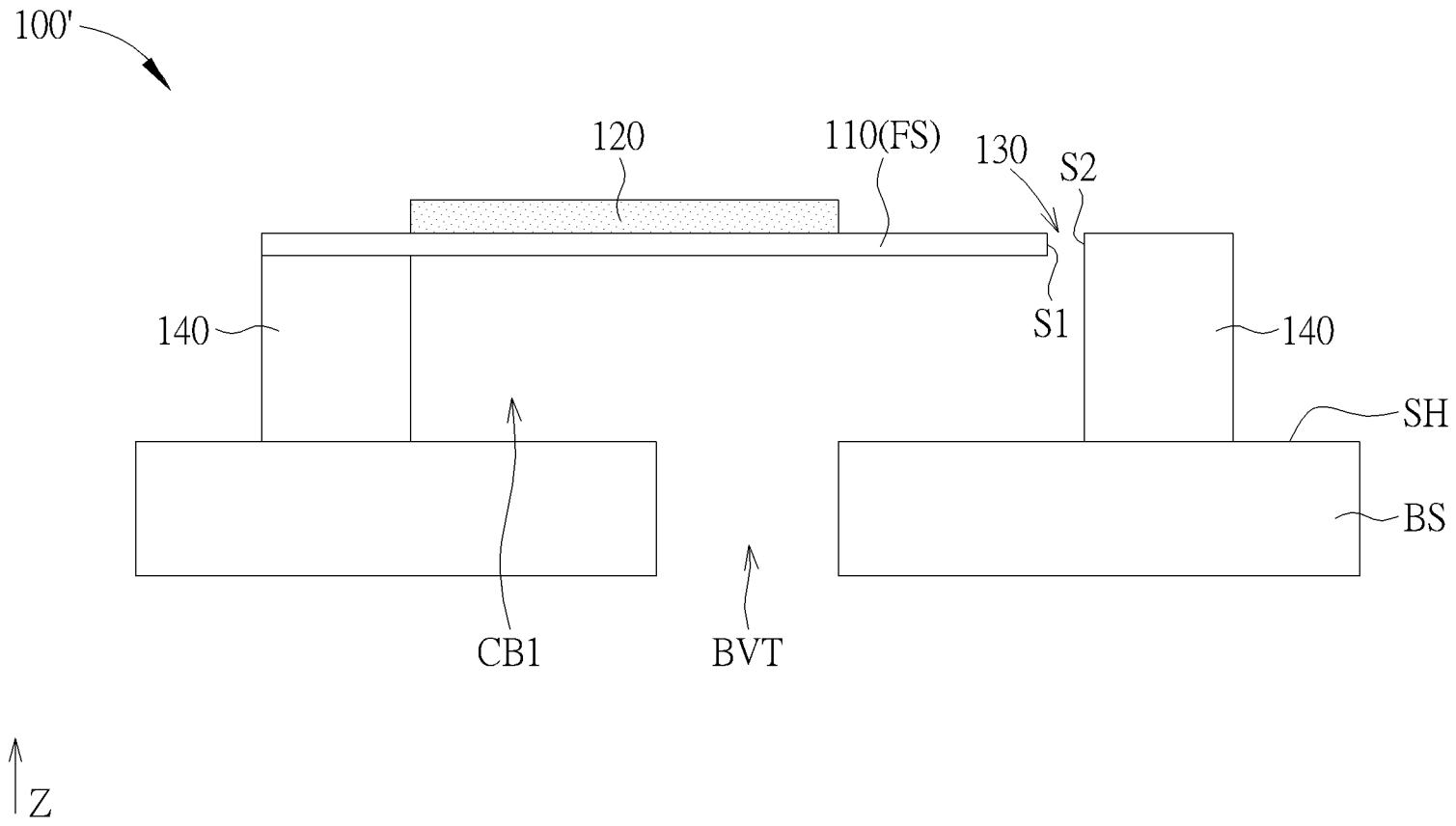
FIG. 10 to FIG. 12 are schematic diagrams of cross sectional views illustrating another type acoustic transducer according to an embodiment of the present invention.
Figure 11:
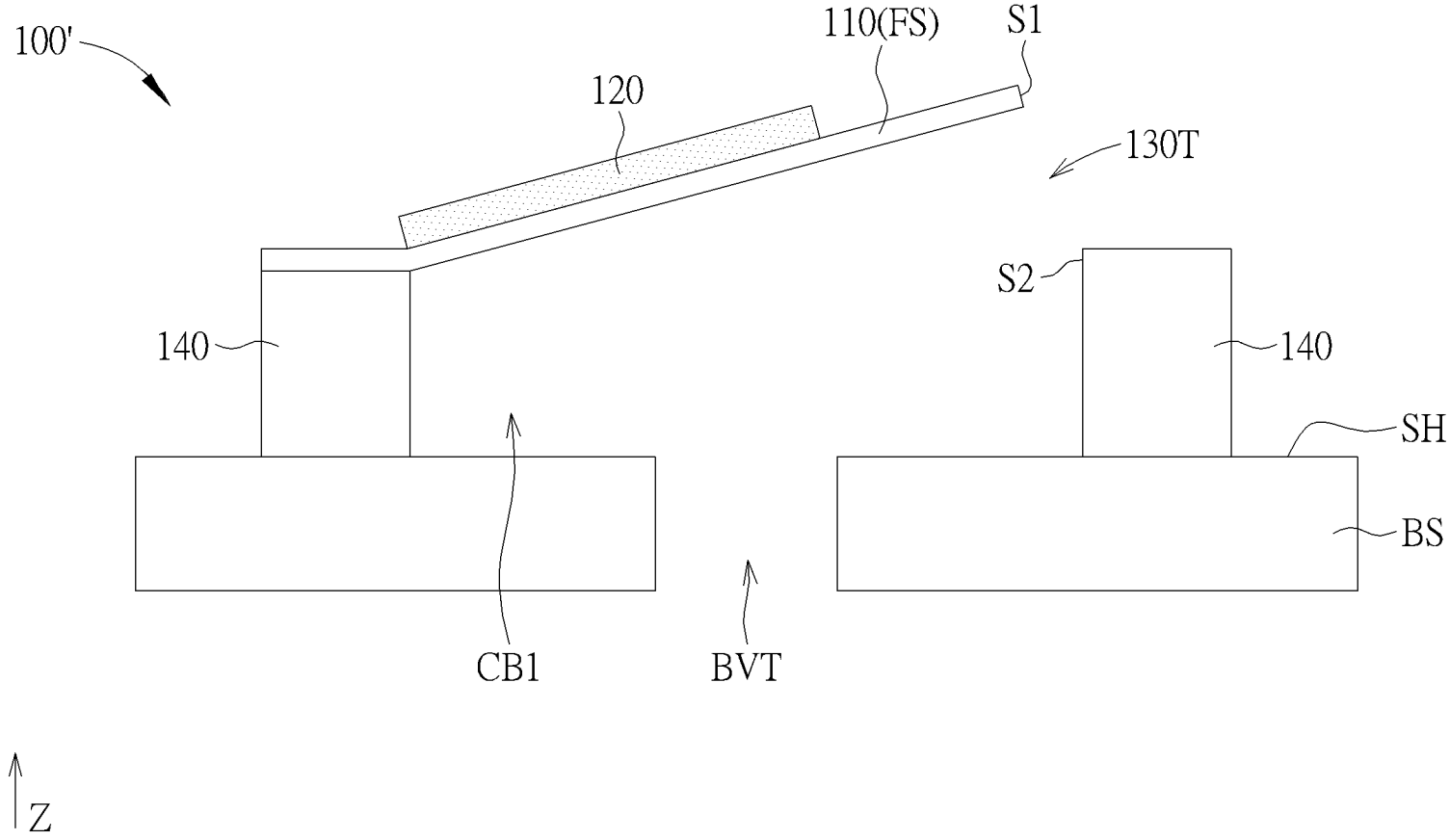
Figure 12:
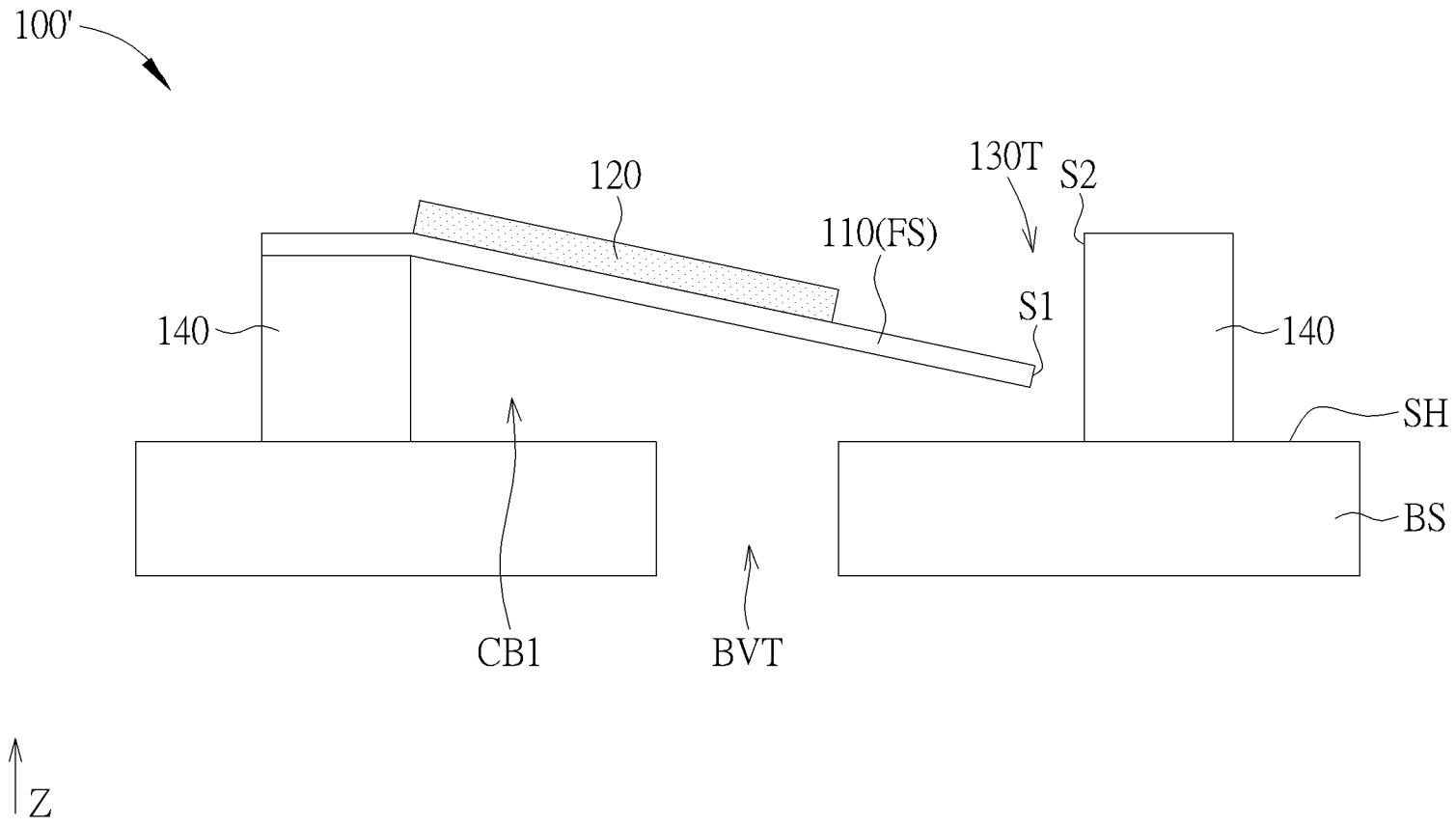

Referring to FIG. 10 to FIG. 12, FIG. 10 to FIG. 12 are schematic diagrams of cross sectional views illustrating another type acoustic transducer according to an embodiment of the present invention, wherein FIG. 10 shows the second mode of the acoustic transducer 100', and FIG. 11 and FIG. 12 show the first mode of the acoustic transducer 100'. As shown in FIG. 10 to FIG. 12, a difference between this acoustic transducer 100' and the acoustic transducer 100 is that the first membrane 110 of the acoustic transducer 100' of this embodiment includes the first sidewall S1 of the slit 130, but the first membrane 110 does not include the second sidewall S2 of the slit 130. Namely, the slit 130 is a part of the boundary of the first membrane 110 (i.e., the first sidewall S1 of the slit 130 may be one of the outer edges 110*e* of the first membrane 110). In FIG. 10 to FIG. 12, the second sidewall S2 of the slit 130 may be stationary/immobile during the operation of the acoustic transducer 100'. For example, the second sidewall S2 of the slit 130 may belong to the anchor structure 140, but not limited thereto. Because of the design of the slit 130 shown in FIG. 10 to FIG. 12, the anchor structure 140 may be not connected to a portion of the outer edges 110*e* of the first membrane 110, but not limited thereto.

In another aspect, as shown in FIG. 10 to FIG. 12, the first membrane 110 only include the first flap and does not include the second flap, wherein the first end of the first flap is anchored by one anchor structure 140, the second/free end of the first flap is configured to perform the first up-and-down movement (i.e., the second end of the first flap may move upwardly and downwardly) to form the vent 130T (the vent 130T is shown in FIG. 11 and FIG. 12), and the first sidewall S1 of the slit 130 belongs to the second/free end of the first flap.

In this design, because the second sidewall S2 is stationary/immobile during the operation of the acoustic transducer 100', the vent 130T may be formed by increasing the driving signal applied to first actuator 120 to cause the first sidewall S1 to move upwards in the direction Z, as in the case of FIG. 11. For example, the voltage across the electrodes of the first actuator 120 is 30V, so as to make the first sidewall S1 move upwards in the direction Z, but not limited thereto. Alternatively, in the case of FIG. 12, the first membrane 110 may have a negative initial displacement, i.e. the displacement of the first sidewall S1 in the direction Z may be −18 μm, as an example, when voltage across the electrodes of the first actuator 120 is 0V. Assuming the membrane thickness is 5 μm, as an example, meaning the height of the first sidewall S1 is 5 μm and status of the vent 130T, when 0V is applied to the first actuator 120, is "opened" with the opening size of the vent 130T equals to 18-5=13 μm. As such, in this embodiment, the vent 130T may be put in the second mode by applying a positive driving signal (e.g., 16V) to the first actuator 120 to cause the surface of the first membrane 110 to become substantially parallel to the horizontal surface SH, such as illustrated in FIG. 10; and the vent 130T may be put in the first mode by applying 0V to the first actuator 120.

Figure 13:
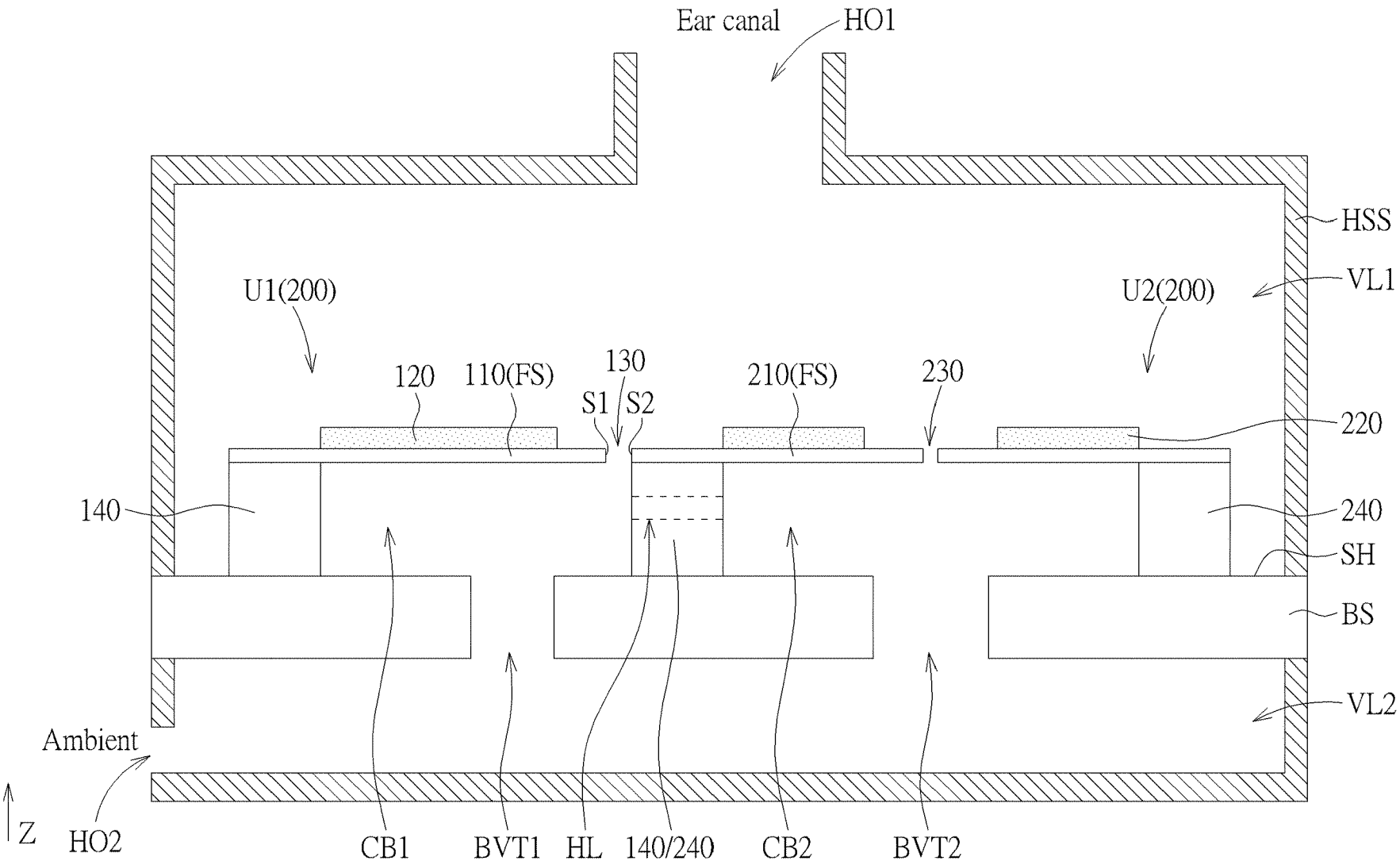
FIG. 13 is a schematic diagram of a cross sectional view illustrating the acoustic transducer according to a second embodiment of the present invention.

Referring to FIG. 13, FIG. 13 is a schematic diagram of a cross sectional view illustrating the acoustic transducer according to a second embodiment of the present invention. As shown in FIG. 13, a difference between this embodiment and the first embodiment is that the acoustic transducer 200 of this embodiment further includes a second membrane 210, a second actuator 220 and an anchor structure 240 which are disposed on the horizontal surface SH of the base BS, wherein the second membrane 210 is anchored by the anchor structure 240, the second actuator 220 is configured to actuate the second membrane 210, and a second chamber CB2 exists between the base BS and the second membrane 210. In this embodiment, the film structure FS may include the first membrane 110 and the second membrane 210, but not limited thereto. In this embodiment, the acoustic transducer 200 may optionally include a chip disposed on the horizontal surface SH of the base BS, and the chip may include the film structure FS (including the first membrane 110 and the second membrane 210), the first actuator 120, the second actuator 220 and the anchor structures 140 and 240 at least (i.e., these structures are integrated in one chip), but not limited thereto.

The function provided from the first membrane 110 and the first actuator 120 is different from the function provided from the second membrane 210 and the second actuator 220. In this embodiment, the first membrane 110 and the first actuator 120 may be configured to suppress the occlusion effect, and the second membrane 210 and the second actuator 220 may be configured to perform the acoustic transformation. That is to say, the first membrane 110 and the first actuator 120 do not perform the acoustic transformation.

In detail, in the first mode, the first actuator 120 may generate the vent 130T formed between the first sidewall S1 and the second sidewall S2 of the slit 130 in the direction Z (the normal direction of the horizontal surface SH of the base BS). In the second mode, the first actuator 120 may not generate the vent 130T between the first sidewall S1 and the second sidewall S2 of the slit 130 in the direction Z. Whether the acoustic transducer 200 is in the first mode or the second mode, the second actuator 220 may receive an acoustic driving signal corresponding to (related to) the value(s) of the input audio signal to generate the acoustic wave. Namely, the driving signal(s) applied on the first actuator 120 may not be corresponding to (related to) the value(s) of the input audio signal. For instance, in the first driving method, the first driving signal may include a vent generating signal (e.g., the 30V in discussion associated with FIG. 11 or the 0V in discussion associated with FIG. 12), and the second driving signal may include a vent restraining signal (e.g., the 16V in discussion associated with FIG. 10), but not limited thereto.

The second membrane 210, the second actuator 220 and the anchor structure 240 may be designed based on requirement(s), wherein the design of the second membrane 210, the second actuator 220 and the anchor structure 240 needs to be suitable for generating the acoustic wave. For instance, in this embodiment, the top view of the second membrane 210, the second actuator 220 and the anchor structure 240 may be similar to the first membrane 110, the first actuator 120 and the anchor structure 140 of the first embodiment shown in FIG. 1, but not limited thereto. Note that the second membrane 210 may have at least one slit 230, such that the displacement of the second membrane 210 may be increased and/or the second membrane 210 may deform elastically during the operation of the acoustic transducer 200, but not limited thereto.

The material and the type of the second membrane 210 may be referred to the first membrane 110 described in the first embodiment, and thus, these will not be redundantly described. The material and the type of the second actuator 220 may be referred to the first actuator 120 described in the first embodiment, and thus, these will not be redundantly described. The material of the anchor structure 240 may be referred to the anchor structure 140 described in the first embodiment, and thus, this will not be redundantly described.

Note that the second membrane 210, the slit(s) 230, the second actuator 220 and the anchor structure 240 may be considered as a second unit U2.

The first unit U1 may be designed based on requirement(s), wherein the design of the first membrane 110, the first actuator 120 and the slit(s) 130 needs to be suitable for suppressing the occlusion effect. In this embodiment, the first membrane 110 of the first unit U1 of this embodiment includes the first sidewall S1 of the slit 130 but does not include the second sidewall S2 of the slit 130 (i.e., the first membrane 110 only include the first flap and does not include the second flap). For example, as shown in FIG. 13, the first unit U1 may be similar to the acoustic transducer 100' shown in FIG. 10, but not limited thereto.

Moreover, the first chamber CB1 may be connected to the second chamber CB2. In this embodiment, the base BS may include a plurality back vents BVT1 and BVT2, the first chamber CB1 may be connected to the rear outside of the acoustic transducer 200 (i.e., a space on the back of the base BS) through the back vent BVT1, the second chamber CB2 may be connected to the rear outside of the acoustic transducer 200 (i.e., a space on the back of the base BS) through the back vent BVT2, and the first chamber CB1 may be connected to the second chamber CB2 through the back vent BVT1, the rear outside of the acoustic transducer 200 (i.e., a portion of the second volume VL2) and the back vent BVT2, but not limited thereto.

In another embodiment, an air channel may exist between the first membrane 110 and the base BS, such that the first chamber CB1 may be connected to the second chamber CB2 through the air channel. For instance, the air channel may be a hole HL passing through the two opposite lateral sides of the anchor structure 140/240, such that the first chamber CB1 may be connected to the second chamber CB2 through the hole HL, but not limited thereto.

During fabrication, as will be detailed later in the present disclosure, the first membrane 110 and the second membrane 210 may all be fabricated during one single planar thin film fabrication sequence; the first actuator 120 and the second actuator 220 may all be fabricated during another single planar thin film fabrication sequence; and the first chamber CB1, the second chamber CB2 and the anchor structures 140, 240, 140/240 may be formed during one single bulk silicon etching sequence.

Figure 14:
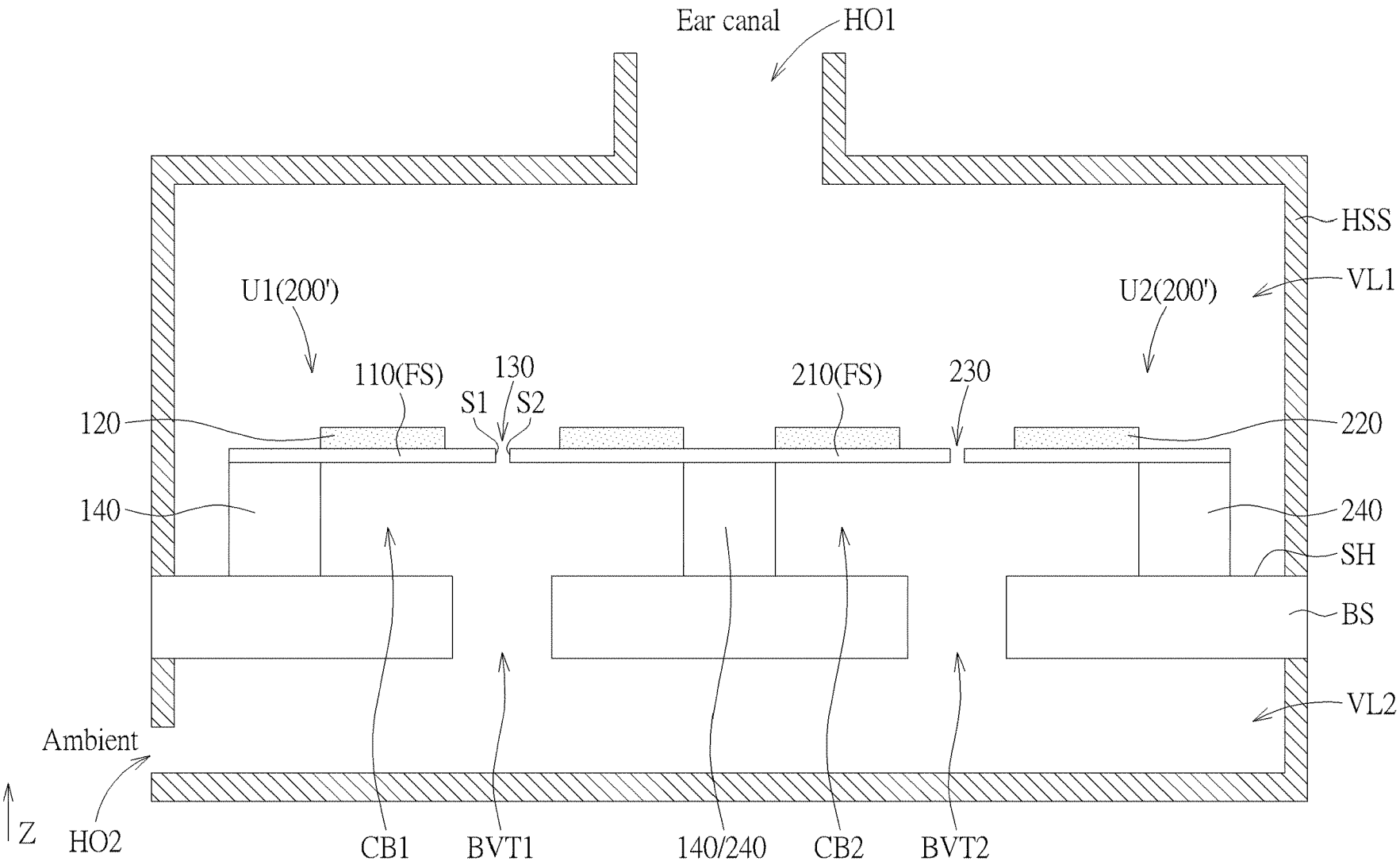
FIG. 14 is a schematic diagram of a cross sectional view illustrating the acoustic transducer according to another second embodiment of the present invention.

Referring to FIG. 14, FIG. 14 is a schematic diagram of a cross sectional view illustrating the acoustic transducer according to another second embodiment of the present invention. As shown in FIG. 14, compared with the acoustic transducer 200 in FIG. 13, the first membrane 110 of the first unit U1 of the acoustic transducer 200' includes the first sidewall S1 and the second sidewall S2 of the slit 130 (i.e., the first membrane 110 include the first flap and the second flap). For example, as shown in FIG. 14, the first unit U1 may be similar to the acoustic transducer 100 shown in FIG. 1, but not limited thereto.

In some embodiment, such as illustrated in FIG. 14, the design of the first unit U1 (the first membrane 110, the first actuator 120 and the slit 130) may have the same cross-section, from a particular perspective, as the design of the second unit U2 (the second membrane 210, the second actuator 220, the slit 230).

Figure 15:
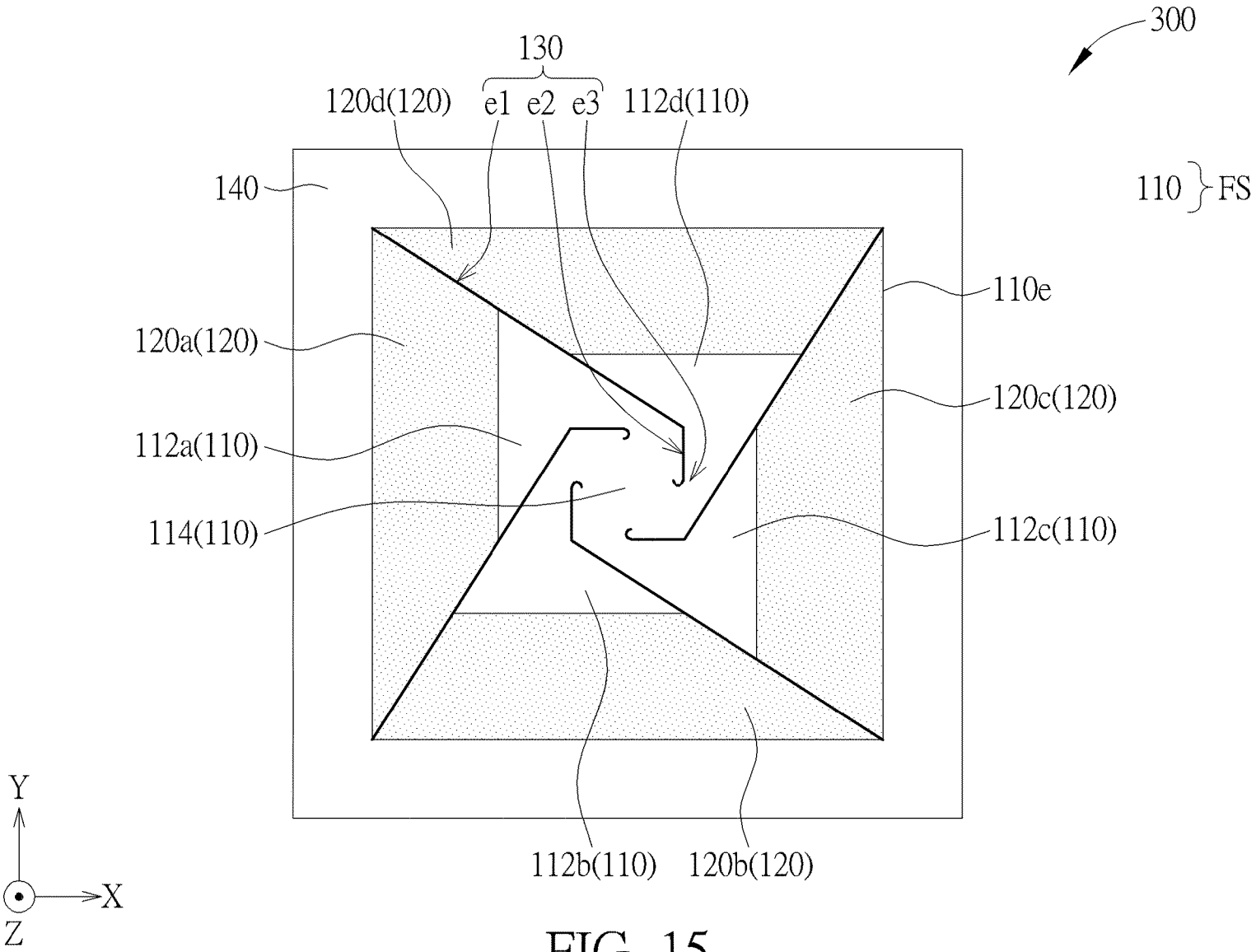
FIG. 15 is a schematic diagram of a top view illustrating an acoustic transducer according to a third embodiment of the present invention.

Referring to FIG. 15, FIG. 15 is a schematic diagram of a top view illustrating an acoustic transducer according to a third embodiment of the present invention. Note that the design of the membrane, the actuator, the slit(s) and the anchor structure of the acoustic transducer 300 of the third embodiment may be applied to the first unit U1 and/or the second unit U2.

As shown in FIG. 15, a difference between the first embodiment and this embodiment is the arrangement of the slits 130 and the first actuator 120. In this embodiment, the slit 130 may be a combination of straight slits and curved slits. In FIG. 15, the slit 130 of this embodiment may include a first portion e1, a second portion e2 connected to the first portion e1 and a third portion e3 connected to the second portion e2, and the first portion e1, the second portion e2 and the third portion e3 are arranged in sequence from the outer edge 110*e* to the inner of the first membrane 110. In the slit 130, the first portion e1 and the second portion e2 may be straight slits extending different direction, and the third portion e3 may be a curved slit, but not limited thereto. The third portion e3 might have a hook-shaped curved end of the slit 130, wherein the hook-shaped curved ends surround the coupling plate 114 of the first membrane 110. The hook-shaped curved end implies that, a curvature at the curved end or at the third portion e3 is larger than curvature(s) at the first portion e1 or the second portion e2, from a top view perspective. In addition, the slit 130 with the hook shape extends toward the center of the first membrane 110, or toward the coupling plate 114 within the first membrane 110. The slit 130 may be carving out a fillet in the first membrane 110.

The curved end of the third portion e3 may be configured to minimize stress concentration near the end of the slit 130.

Figure 16:
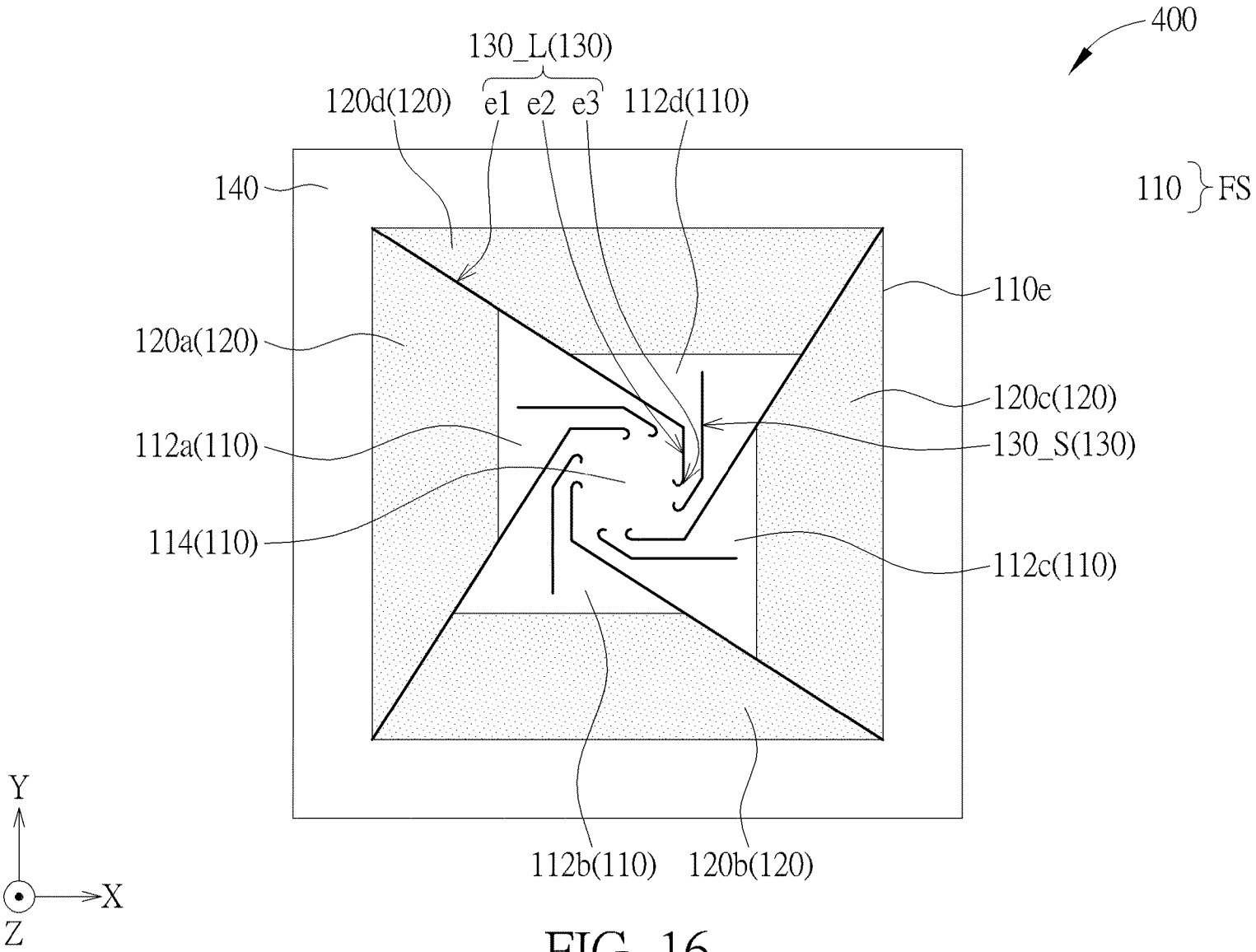
FIG. 16 is a schematic diagram of a top view illustrating an acoustic transducer according to a fourth embodiment of the present invention.

Referring to FIG. 16, FIG. 16 is a schematic diagram of a top view illustrating an acoustic transducer according to a fourth embodiment of the present invention. Note that the design of the membrane, the actuator, the slit(s) and the anchor structure of the acoustic transducer 400 of the fourth embodiment may be applied to the first unit U1 and/or the second unit U2.

As shown in FIG. 16, a difference between the third embodiment and this embodiment is the arrangement of the slits 130. In this embodiment, some slits 130 may be shorter, and each shorter slit 130_S is between two longer slits 130_L, but not limited thereto. In FIG. 16, the shorter slit 130_S may not be connected to the outer edge 110*e* of the first membrane 110, but not limited thereto.

The shorter slit 130_S may be a combination of straight slits and curved slits, and the pattern of the shorter slit 130_S may be similar to the pattern of the longer slit 130_L. Moreover, in FIG. 16, the shorter slit 130_S may not be situated in the region on which the first actuator 120 is disposed, but not limited thereto.

Figure 17:
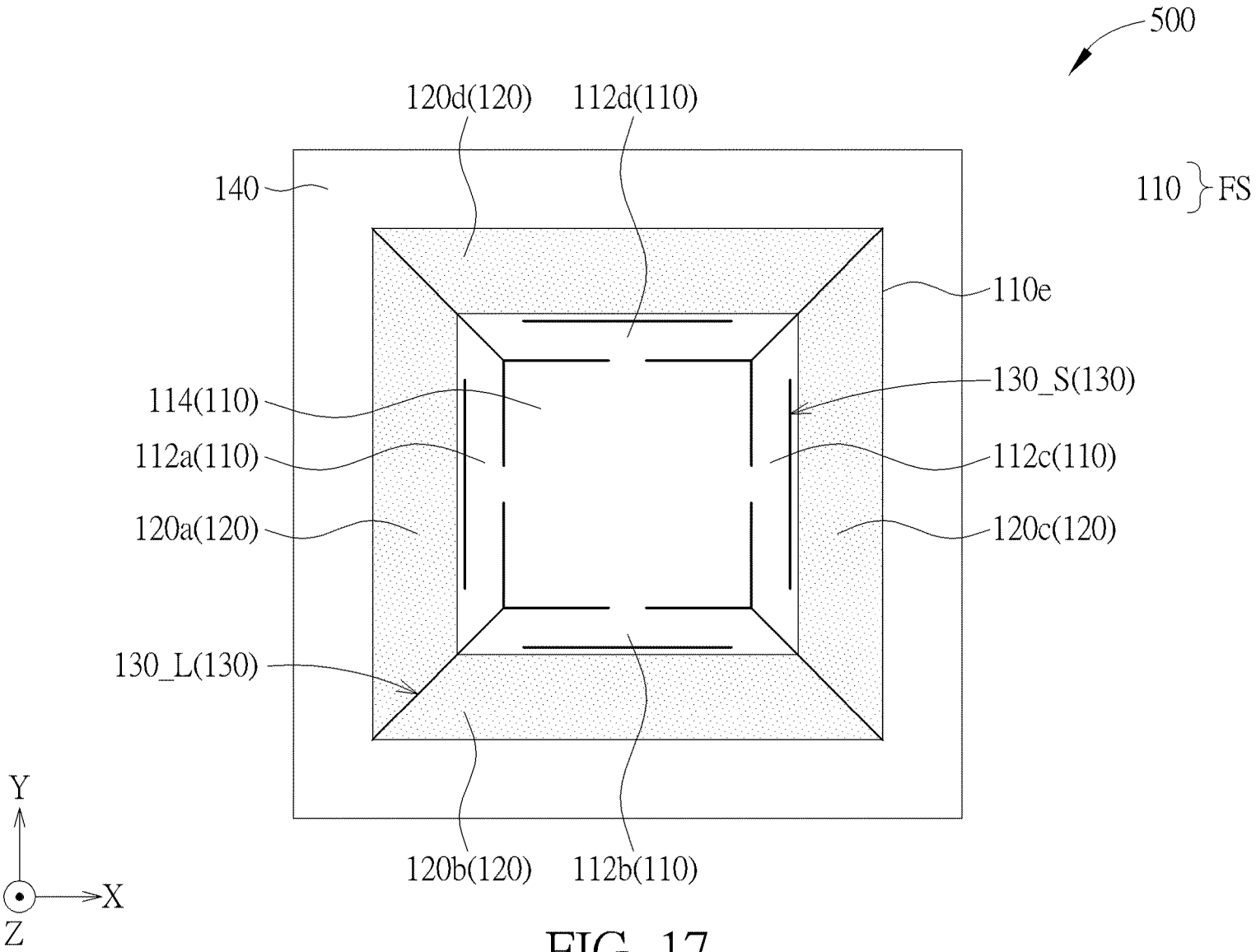
FIG. 17 is a schematic diagram of a top view illustrating an acoustic transducer according to a fifth embodiment of the present invention.

Referring to FIG. 17, FIG. 17 is a schematic diagram of a top view illustrating an acoustic transducer according to a fifth embodiment of the present invention. Note that the design of the membrane, the actuator, the slit(s) and the anchor structure of the acoustic transducer 500 of the fifth embodiment may be applied to the first unit U1 and/or the second unit U2.

As shown in FIG. 17, a difference between the first embodiment and this embodiment is the arrangement of the slits 130 and the first actuator 120. In this embodiment, the longer slit 130_L may be a combination of straight slits (e.g., three straight slits forming a Y-shape), but not limited thereto. In this embodiment, the shorter slit 130_S may be between two longer slits 130_L, and the shorter slit 130_S may not be connected to the outer edge 110*e* of the first membrane 110, but not limited thereto. In FIG. 17, the shorter slit 130_S may be a straight slit, and the shorter slit 130_S may be parallel to a portion of the longer slit 130_L, but not limited thereto.

Figure 18:
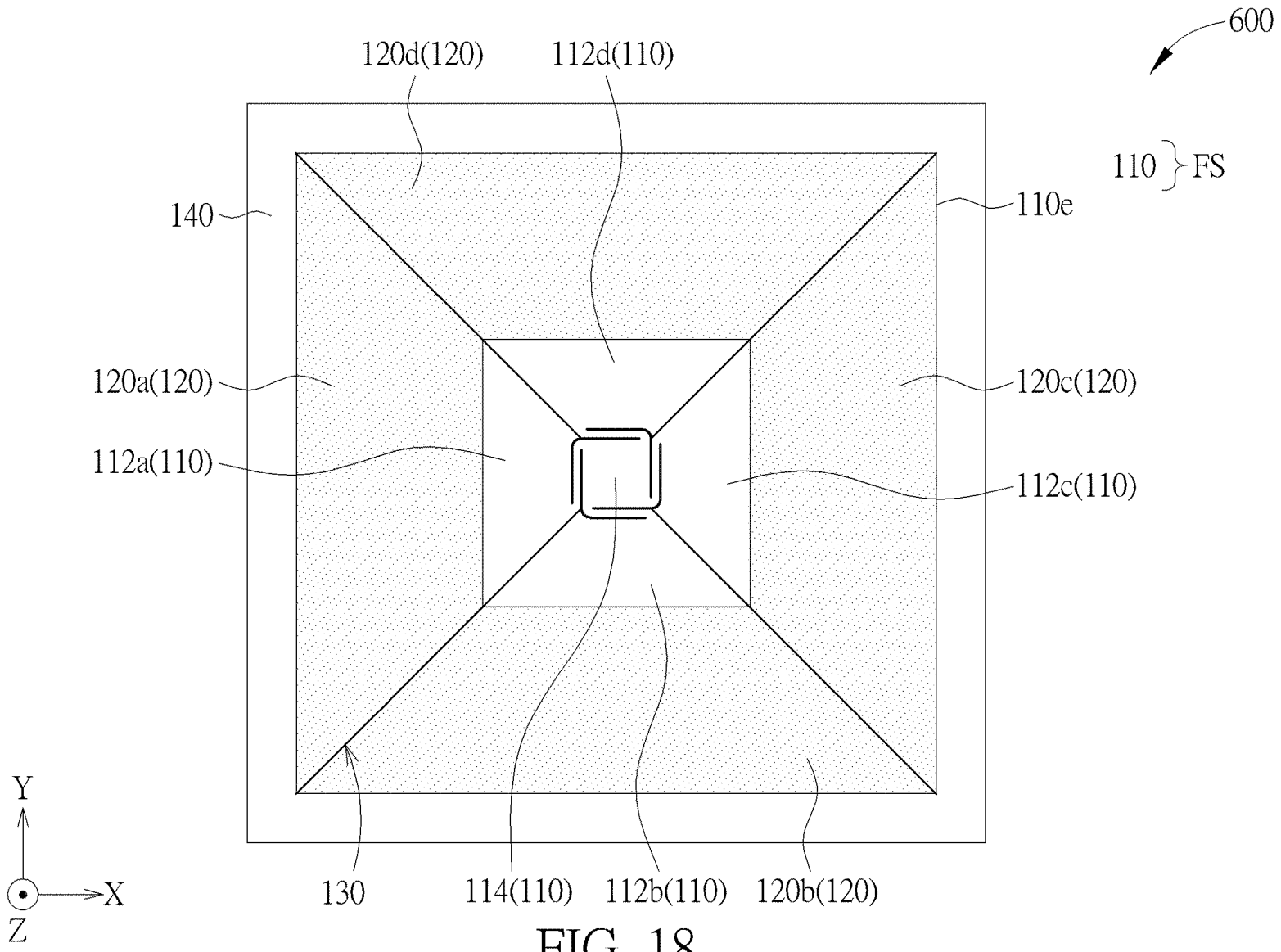
FIG. 18 is a schematic diagram of a top view illustrating an acoustic transducer according to a sixth embodiment of the present invention.

Referring to FIG. 18, FIG. 18 is a schematic diagram of a top view illustrating an acoustic transducer according to a sixth embodiment of the present invention. Note that the design of the membrane, the actuator, the slit(s) and the anchor structure of the acoustic transducer 600 of the sixth embodiment may be applied to the first unit U1 and/or the second unit U2.

As shown in FIG. 18, a difference between the first embodiment and this embodiment is the arrangement of the slits 130 and the first actuator 120. In this embodiment, the slit 130 may be a combination of straight slits and curved slits (e.g., two straight slits and a combined slit formed of one curved slit and one straight slit, and these slits forming a Y-shape), but not limited thereto.

Referring to the upper portion of FIG. 18 which substantially shows a quarter of the first membrane 110, a straight slit of one slit 130 and a straight slit of a combined slit of another slit 130 are parallel to each other and overlap along the direction Y, but not limited thereto.

Figure 19:
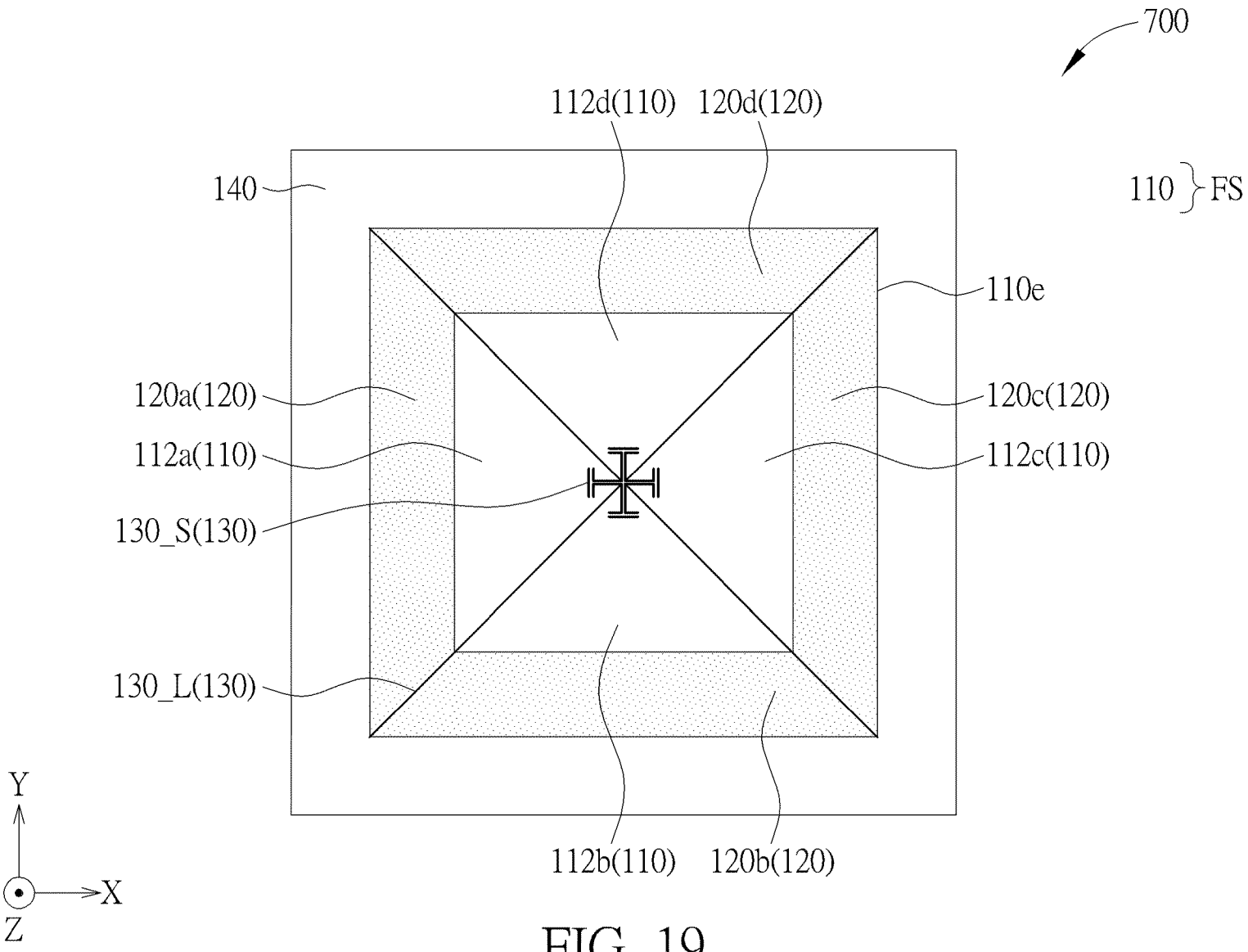
FIG. 19 is a schematic diagram of a top view illustrating an acoustic transducer according to a seventh embodiment of the present invention.
Figure 20:
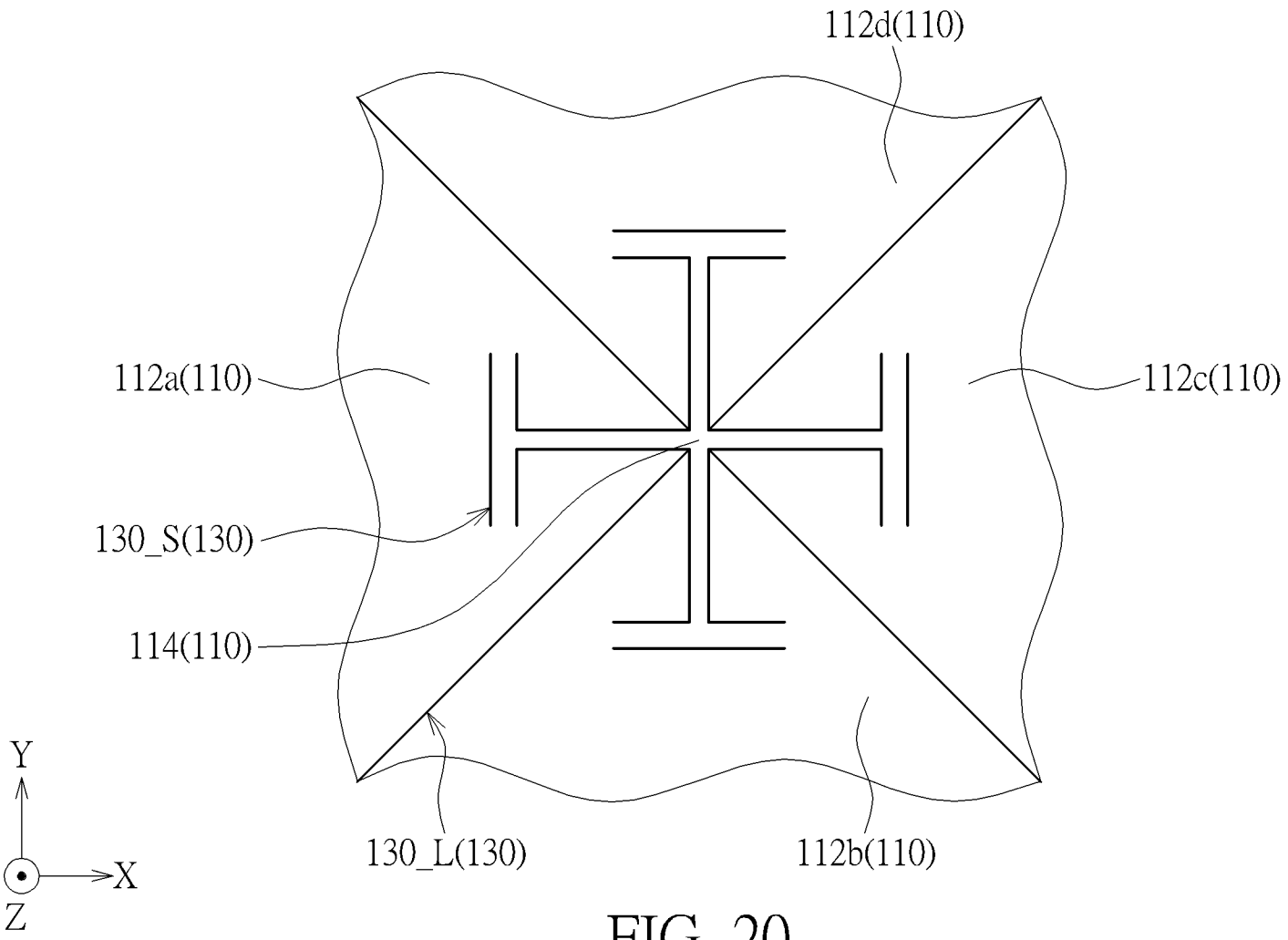
FIG. 20 is an enlarge diagram illustrating a center part of FIG. 19.

Referring to FIG. 19 and FIG. 20, FIG. 19 is a schematic diagram of a top view illustrating an acoustic transducer according to a seventh embodiment of the present invention, and FIG. 20 is an enlarge diagram illustrating a center part of FIG. 19. Note that the design of the membrane, the actuator, the slit(s) and the anchor structure of the acoustic transducer 700 of the seventh embodiment may be applied to the first unit U1 and/or the second unit U2.

As shown in FIG. 19 and FIG. 20, a difference between the first embodiment and this embodiment is the arrangement of the slits 130 and the first actuator 120. In this embodiment, the longer slit 130_L may be a combination of straight slits (e.g., three straight slits), but not limited thereto. In this embodiment, the shorter slit 130_S which is not connected to the outer edge 110*e* of the first membrane 110 may be a straight slit, wherein the shorter slit 130_S may be parallel to a portion of the longer slit 130_L, but not limited thereto.

Moreover, as shown in FIG. 19 and FIG. 20, a ratio of the area of the coupling plate 114 to the area of the first membrane 110 may be much small, but not limited thereto.

Figure 21:
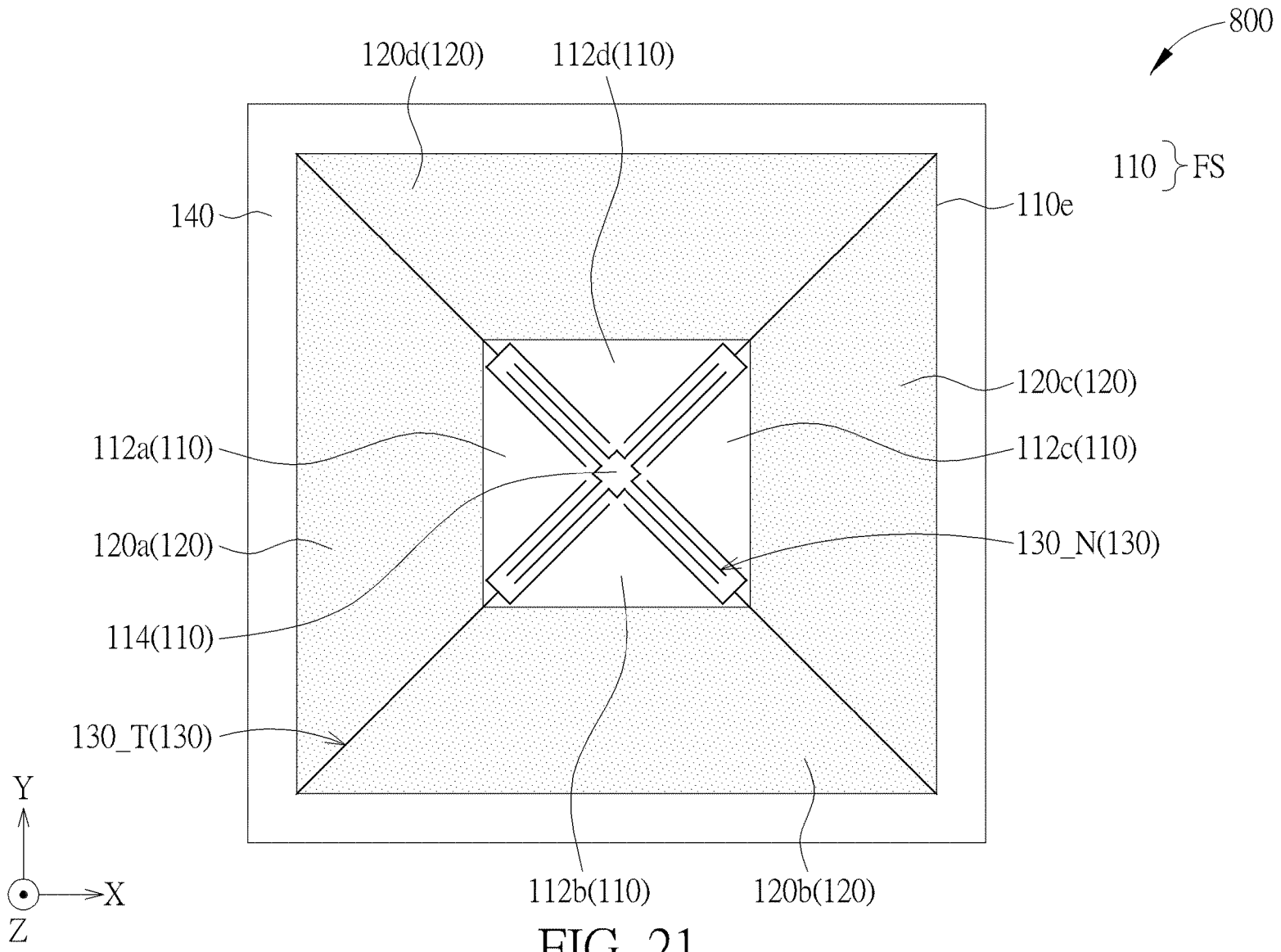
FIG. 21 is a schematic diagram of a top view illustrating an acoustic transducer according to an eighth embodiment of the present invention.

Referring to FIG. 21, FIG. 21 is a schematic diagram of a top view illustrating an acoustic transducer according to an eighth embodiment of the present invention. Note that the design of the membrane, the actuator, the slit(s) and the anchor structure of the acoustic transducer 800 of the eighth embodiment may be applied to the first unit U1 and/or the second unit U2.

As shown in FIG. 21, a difference between the first embodiment and this embodiment is the arrangement of the slits 130 and the first actuator 120. In this embodiment, the outer slit 130_T may be a combination of straight slits forming a Y-shape, but not limited thereto. In this embodiment, the inner slit 130_N which is not connected to the outer edge 110*e* of the first membrane 110 may be a combination of straight slits forming a W-shape. In FIG. 21, a portion of the inner slit 130_N is parallel to a portion of the outer slit 130_T, but not limited thereto.

Moreover, in FIG. 21, a ratio of the area of the coupling plate 114 to the area of the first membrane 110 may be much small, but not limited thereto.

Note that, the arrangements of the slit(s) 130 described in the above embodiments are examples. Any suitable arrangement of the slit(s) 130 can be used in the present invention.

Figure 22:
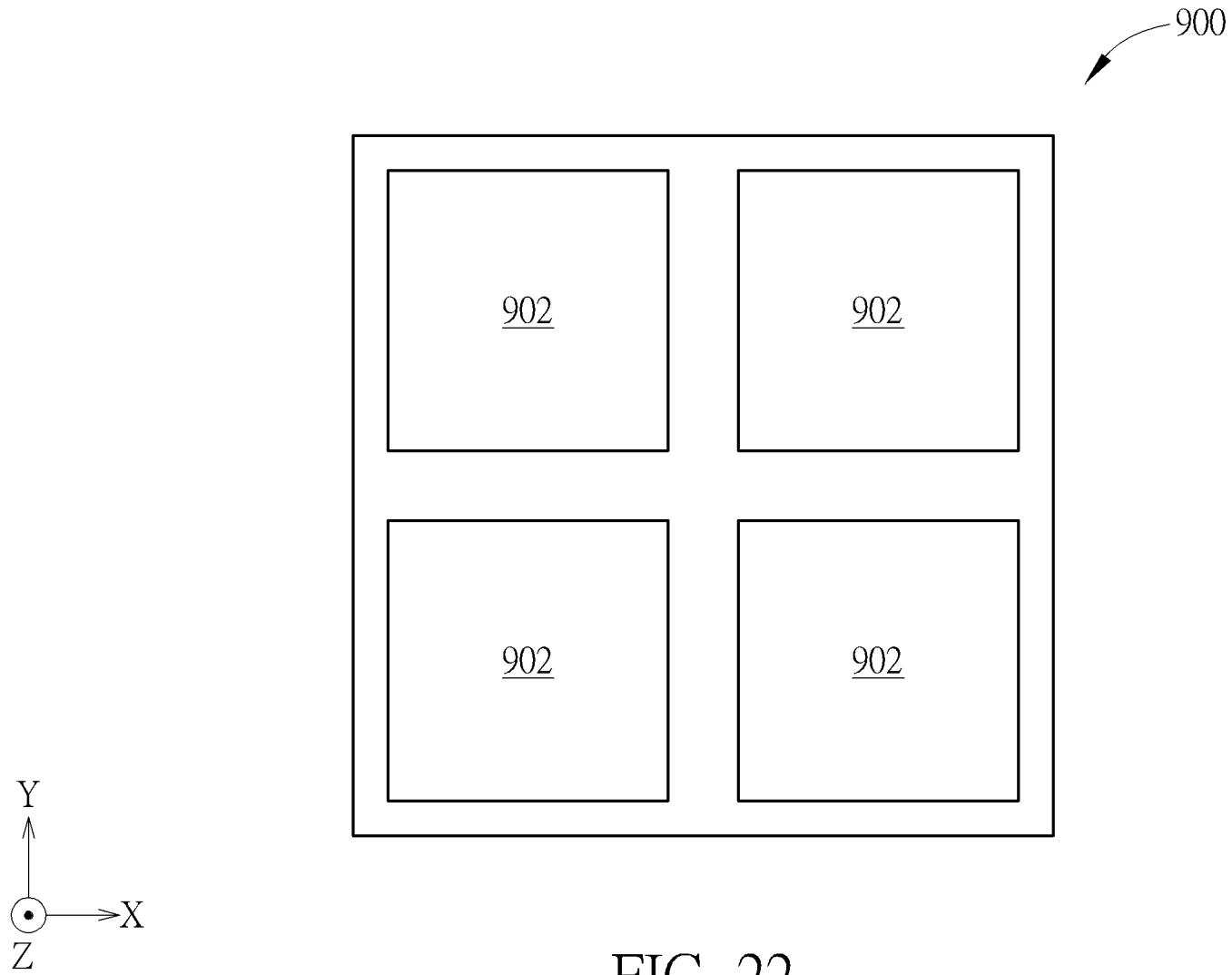
FIG. 22 is a schematic diagram of a top view illustrating an acoustic transducer according to a ninth embodiment of the present invention.

Referring to FIG. 22, FIG. 22 is a schematic diagram of a top view illustrating an acoustic transducer according to a ninth embodiment of the present invention. As shown in FIG. 22, the acoustic transducer 900 may include a plurality of units 902 (i.e., the first unit(s) U1, the second unit(s) U2 or a combination thereof), so as to include a plurality of membranes. In FIG. 22, the acoustic transducer 900 includes four units 902 to form the 2×2 array, but not limited thereto. In the present invention, the acoustic transducer 900 may include one single chip including all units 902, or the acoustic transducer 900 may include a plurality of chips (the chips may be the same or different) to achieve a plurality of units 902.

Note that, FIG. 22 is for illustrative purpose, which demonstrates a concept of the acoustic transducer 900 including multiple sound producing units 902. Construct of each membrane is not limited, and the membranes are the same or different.

Because of the plurality of units 902 included in the acoustic transducer 900, the acoustic wave may be generated by these units 902 with any suitable manner. In some embodiments, the units 902 may generate the acoustic wave at the same time, such that the SPL of the acoustic wave may be greater, but not limited thereto.

In some embodiments, the units 902 may generate the acoustic wave in a temporally interleaved manner. Regarding to the temporally interleaved manner, the sound producing units 902 are divided into a plurality of groups and generate air pulses, air pulses generated by different groups may be temporally interleaved, and these air pulses are combined to be the overall air pulses reproducing the acoustic wave. If the units 902 are divided into M groups, and the array of the air pulses generated by each group has the pulse rate PRG, the overall pulse rate of the overall air pulses is M·PRG. Namely, the pulse rate of the array of the air pulses generated by one group (i.e., one or some unit(s)) is less than the overall pulse rate of the overall air pulses generated by all group (i.e., all of the units 902) if the number of the group is greater than 1.

Figure 23:
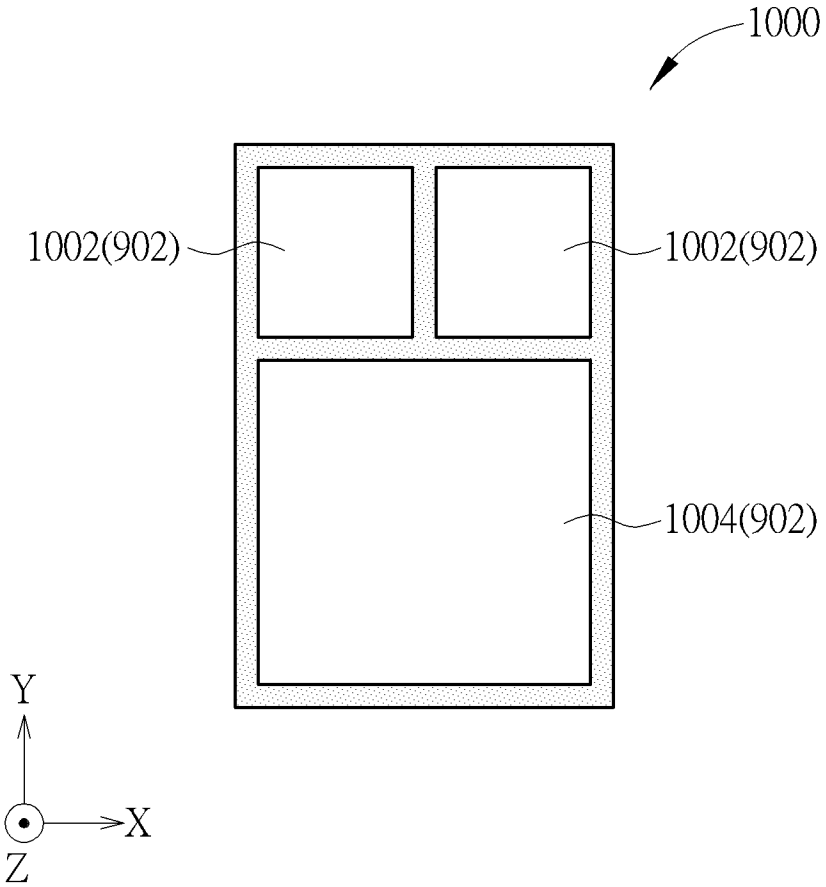
FIG. 23 is a schematic diagram of a top view illustrating an acoustic transducer according to a tenth embodiment of the present invention.

Referring to FIG. 23, FIG. 23 is a schematic diagram of a top view illustrating an acoustic transducer according to a tenth embodiment of the present invention. As shown in FIG. 23, a difference between the ninth embodiment and this embodiment is that the units 902 of the acoustic transducer 1000 of this embodiment may have different sizes, wherein the smaller unit 902 may be a high frequency sound unit (tweeter) 1002, and the greater unit 902 may be a low frequency sound unit (woofer) 1004. Note that the design of the high frequency sound unit 1002 may be the aforementioned first unit U1, the aforementioned second unit U2 or a combination thereof, and the design of the low frequency sound unit 1004 may be the aforementioned first unit U1, the aforementioned second unit U2 or a combination thereof.

In the operation of the acoustic transducer 1000, the high frequency sound unit 1002 configured to the high frequency acoustic transformation, the low frequency sound unit 1004 configured to the low frequency acoustic transformation, but not limited thereto. The details of the high frequency sound unit 1002 and the low frequency sound unit 1004 may be referred to U.S. application Ser. No. 17/153,849 filed by Applicant, which is not narrated herein for brevity.

In the following, the details of a manufacturing method of the acoustic transducer will be further exemplarily explained. Note that the manufacturing method is not limited by the following embodiments which are exemplarily provided, and the manufacturing method may manufacture the acoustic transducer including the first unit(s) U1 and/or the second unit(s) U2. Note that in the following manufacturing method, the actuator (e.g., the first actuator 120 and/or the second actuator 220) in the acoustic transducer may be a piezoelectric actuator for example, but not limited thereto. Any suitable type actuator can be used in the acoustic transducer.

In the following manufacturing method, the forming process may include atomic layer deposition (ALD), a chemical vapor deposition (CVD) and other suitable process(es) or a combination thereof. The patterning process may include such as a photolithography, an etching process, any other suitable process(es) or a combination thereof.

Figure 24:
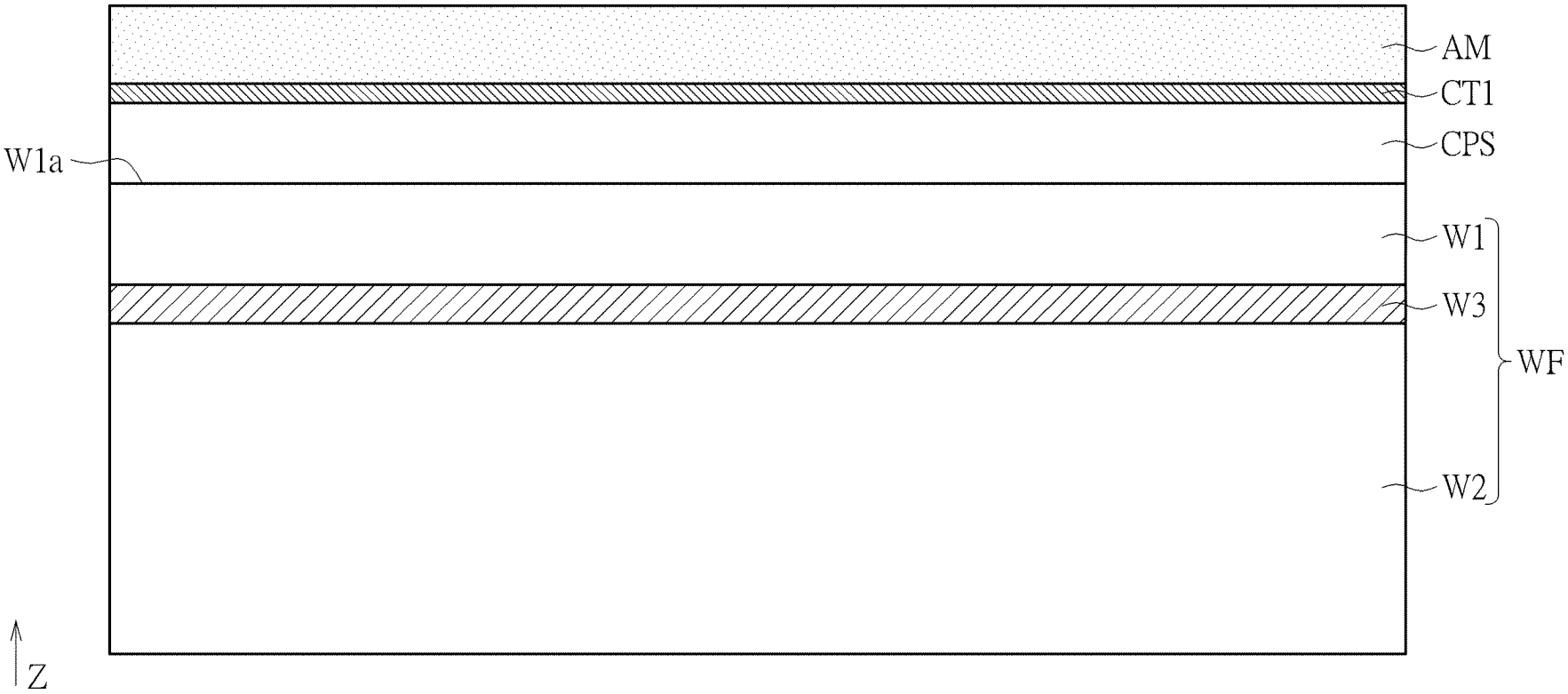
FIG. 24 to FIG. 30 are schematic diagrams illustrating structures at different stages of a manufacturing method of an acoustic transducer according to an embodiment of the present invention.

Referring to FIG. 24 to FIG. 30, FIG. 24 to FIG. 30 are schematic diagrams illustrating structures at different stages of a manufacturing method of an acoustic transducer according to an embodiment of the present invention. In this embodiment, the acoustic transducer may be manufactured by at least one semiconductor process, but not limited thereto. As shown in FIG. 24, a wafer WF is provided, wherein the wafer WF includes a first layer W1, an electrical insulating layer W3 and a second layer W2, wherein the insulating layer W3 is formed between the first layer W1 and the second layer W2.

The first layer W1, the insulating layer W3 and the second layer W2 may individually include any suitable material, such that the wafer WF may be any suitable type. For instance, the first layer W1 and the second layer W2 may individually include silicon (e.g., single crystalline silicon or poly-crystalline silicon), silicon carbide, germanium, gallium nitride, gallium arsenide, stainless steel, and other suitable high stiffness material or a combination thereof. In some embodiments, the first layer W1 may include single crystalline silicon, such that the wafer WF is a silicon on insulator (SOI) wafer, but not limited thereto. In some embodiments, the first layer W1 may include poly-crystalline silicon, such that the wafer WF is a polysilicon on insulator (POI) wafer, but not limited thereto. For instance, the insulating layer W3 may include oxide, such as silicon oxide (e.g., silicon dioxide), but not limited thereto.

The thicknesses of the first layer W1, the insulating layer W3 and the second layer W2 may be individually adjusted based on requirement(s). For example, the thickness of the first layer W1 may be 5 μm, and the thickness of the second layer W2 may be 350 μm, but not limited thereto.

In FIG. 24, a compensation oxide layer CPS may be optionally formed on a first side of the wafer WF, wherein the first side is upper than a top surface W1*a* of the first layer W1 opposite to the second layer W2, such that the first layer W1 is between the compensation oxide layer CPS and the second layer W2. The material of oxide contained in the compensation oxide layer CPS and the thickness of the compensation oxide layer CPS may be designed based on requirement(s).

In FIG. 24, a first conductive layer CT1 and an actuating material AM may be formed on the first side of the wafer WF (on the first layer W1) in sequence, such that the first conductive layer CT1 may be between the actuating material AM and the first layer W1 (e.g., and/or between the actuating material AM and the compensation oxide layer CPS). In some embodiments, the first conductive layer CT1 is in contact with the actuating material AM.

The first conductive layer CT1 may include any suitable conductive material, and the actuating material AM may include any suitable material. In some embodiment, the first conductive layer CT1 may include metal (such as platinum), and the actuating material AM may include a piezoelectric material, but not limited thereto. For example, the piezoelectric material may include such as a lead-zirconate-titanate (PZT) material, but not limited thereto. Moreover, the thicknesses of the first conductive layer CT1 and the actuating material AM may be individually adjusted based on requirement(s).

Figure 25:
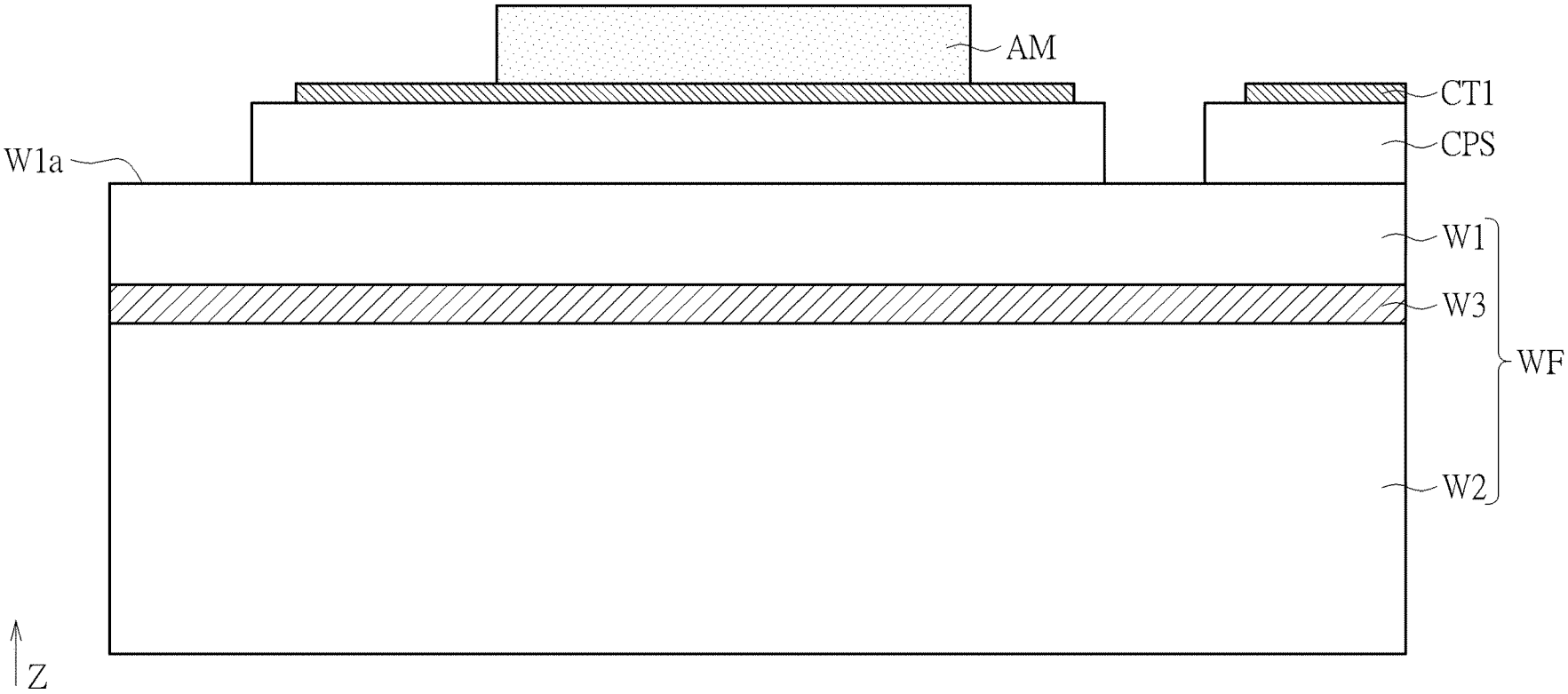

As shown in FIG. 25, the actuating material AM, the first conductive layer CT1 and the compensation oxide layer CPS may be patterned. In some embodiments, the actuating material AM, the first conductive layer CT1 and the compensation oxide layer CPS may be patterned in sequence.

Figure 26:
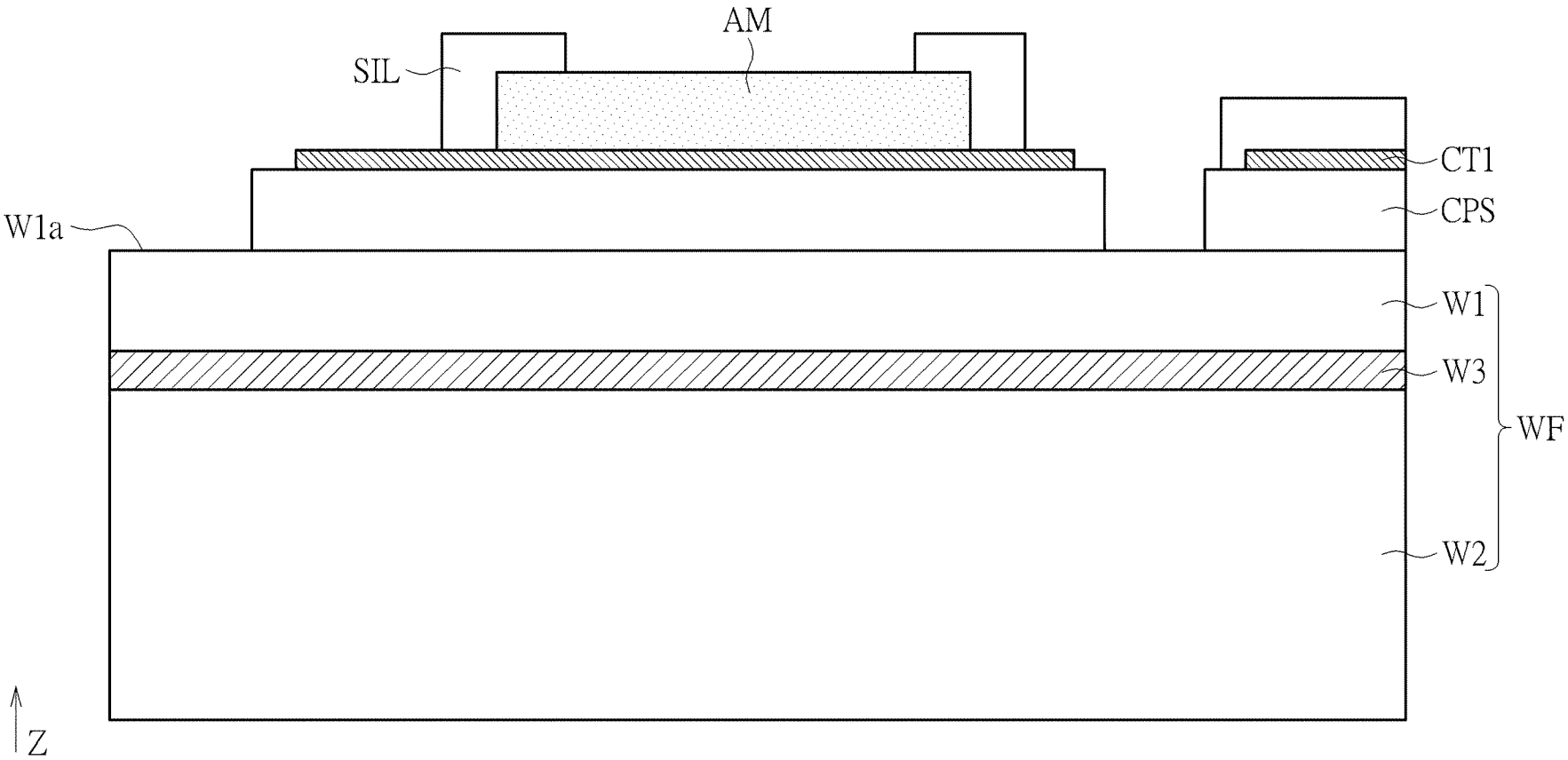

As shown in FIG. 26, a separating insulating layer SIL may be formed on the actuating material AM and be patterned. The thickness of the separating insulating layer SIL and the material of the separating insulating layer SIL may be designed based on requirement(s). For instance, the material of the separating insulating layer SIL may be oxide, but not limited thereto.

Figure 27:
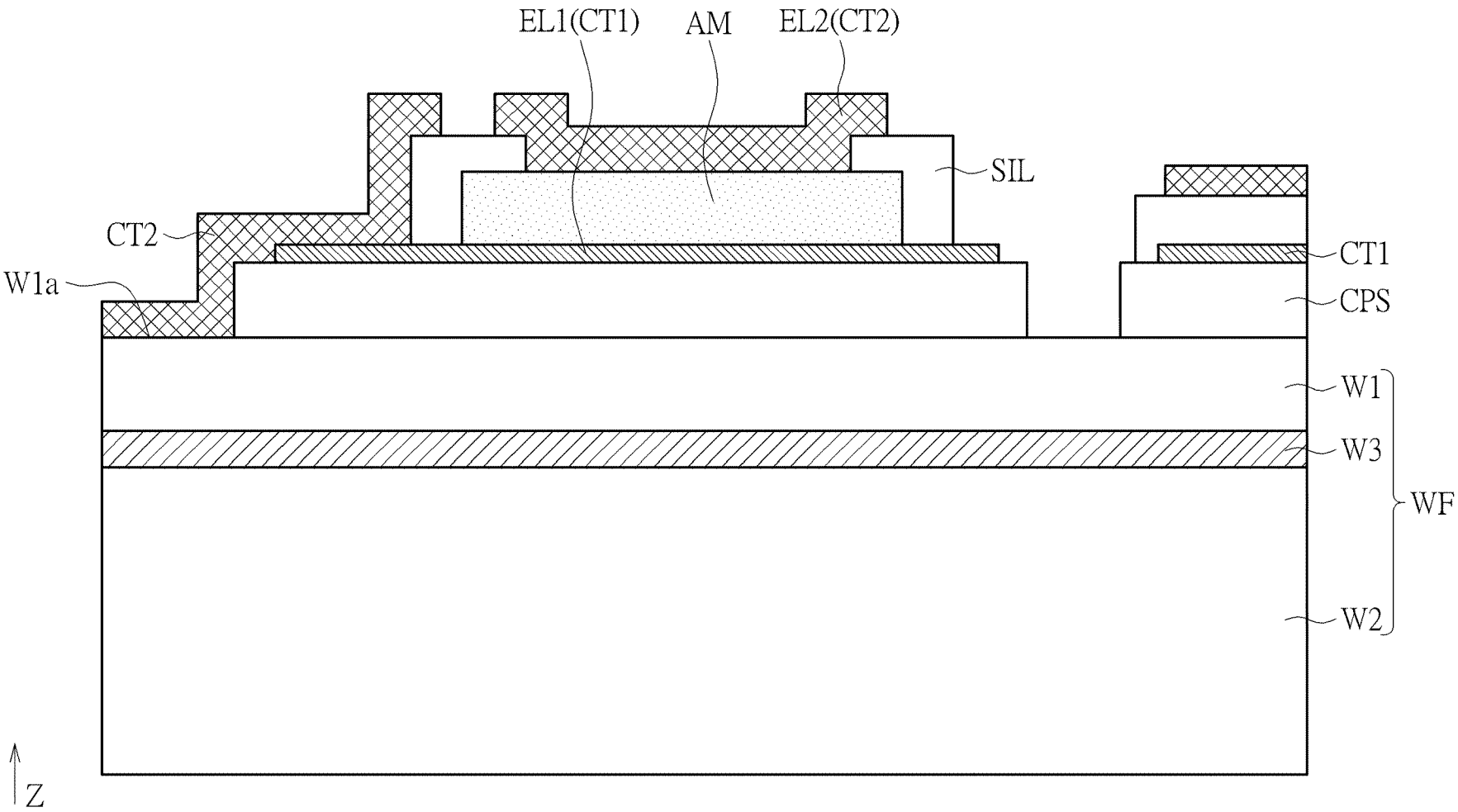

As shown in FIG. 27, a second conductive layer CT2 may be formed on the actuating material AM and the separating insulating layer SIL, and then, the second conductive layer CT2 may be patterned. The thickness of the second conductive layer CT2 and the material of the second conductive layer CT2 may be designed based on requirement(s). For instance, the second conductive layer CT2 may include metal (such as aurum), but not limited thereto.

The patterned first conductive layer CT1 functions as the first electrode EL1 for the actuator, the patterned second conductive layer CT2 functions as the second electrode EL2 for the actuator, and the actuating material AM, the first electrode EL1 and the second electrode EL2 may be components in the actuator (e.g., the first actuator 120 and/or the second actuator 220) in the acoustic transducer, so as to make the actuator be a piezoelectric actuator. For example, the first electrode EL1 and the second electrode EL2 are in contact with the actuating material AM, but not limited thereto.

In FIG. 27, the separating insulating layer SIL may be configured to separate at least a portion of the first conductive layer CT1 from at least a portion of the second conductive layer CT2.

Figure 28:
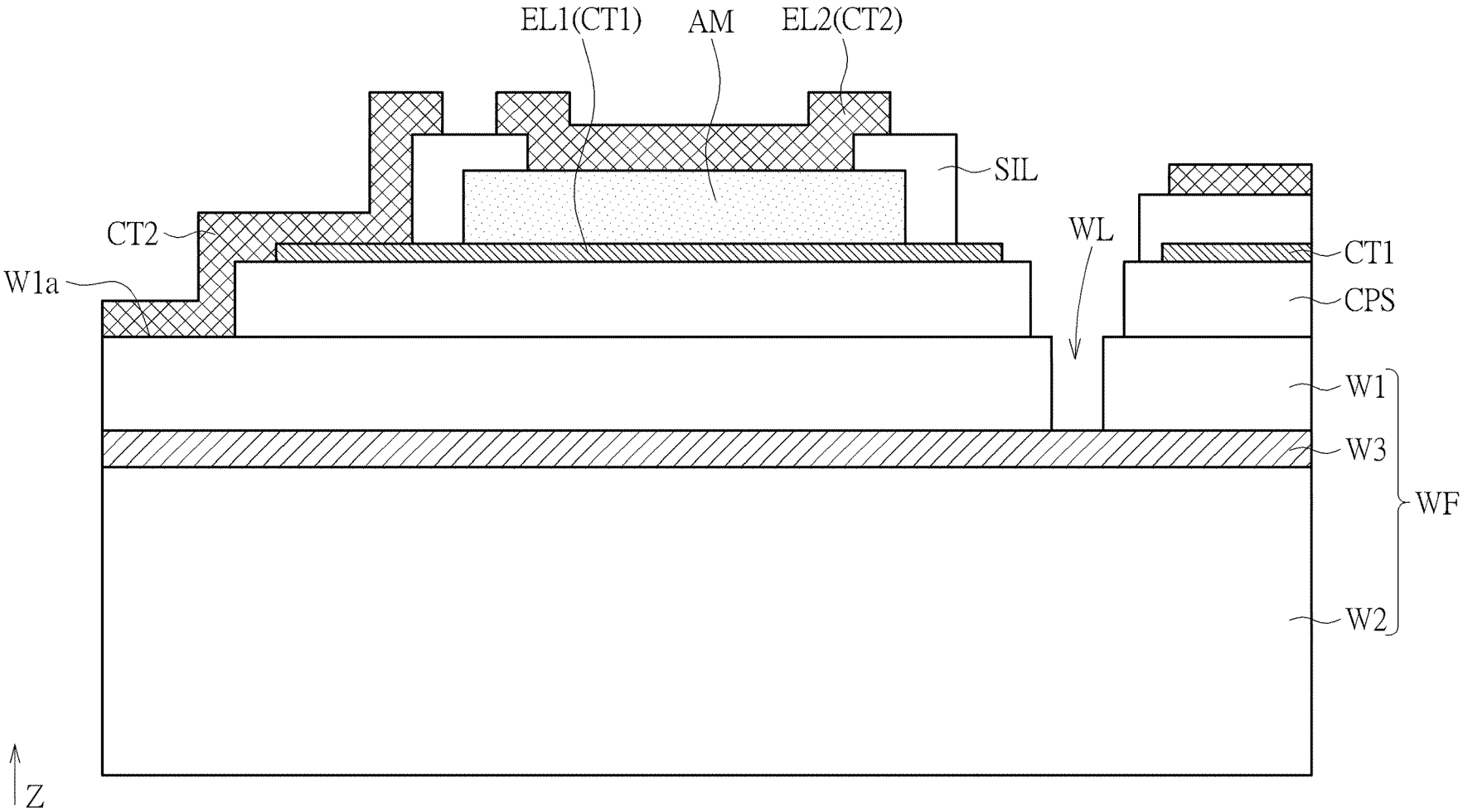

As shown in FIG. 28, the first layer W1 of the wafer WF may be patterned, so as to form a trench line WL. In FIG. 28, the trench line WL is a portion where the first layer W1 is removed. That is to say, the trench line WL is between two parts of the first layer W1.

Figure 29:
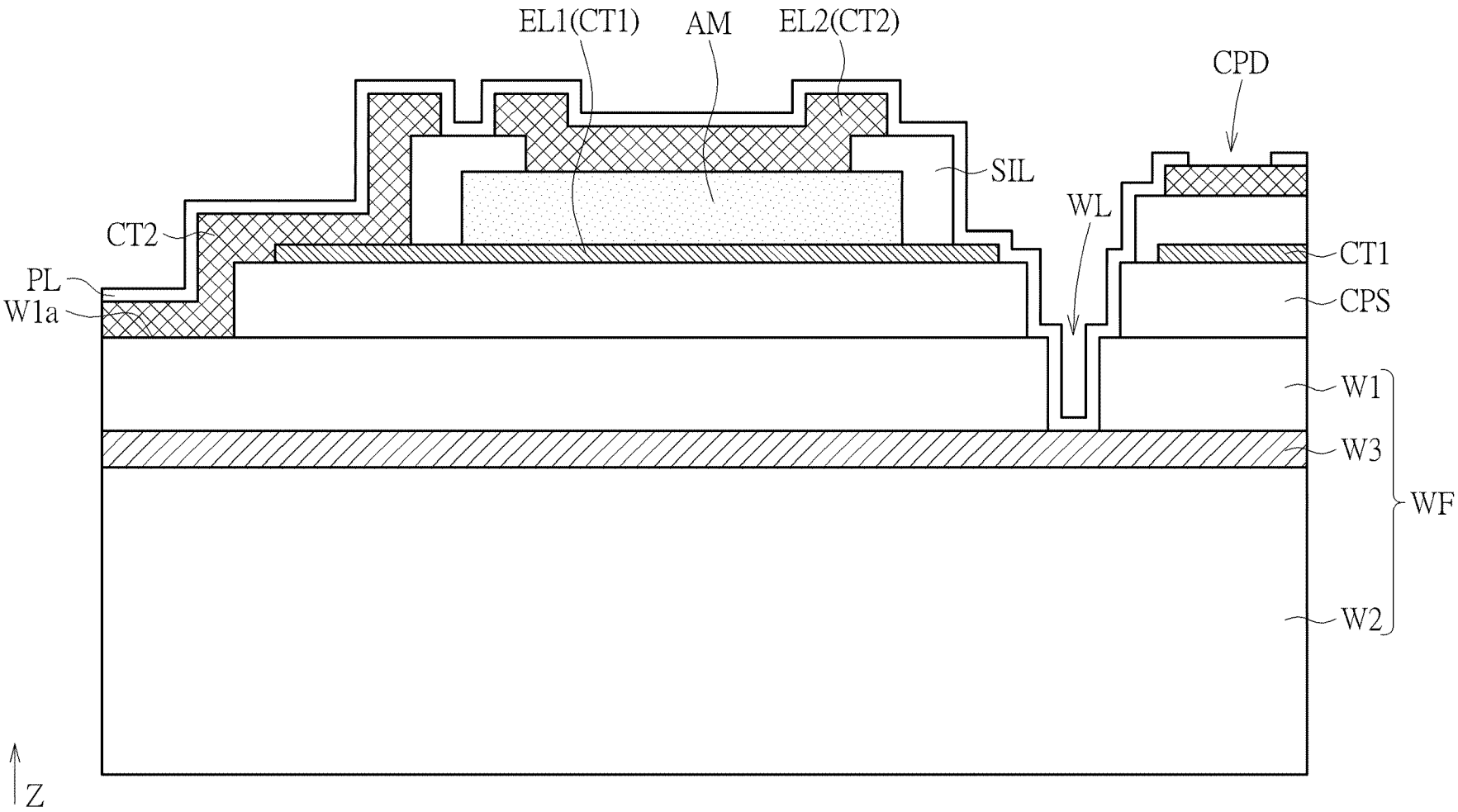

As shown in FIG. 29, a protection layer PL may be optionally formed on the second conductive layer CT2, so as to cover the wafer WF, the first conductive layer CT1, the actuating material AM, the separating insulating layer SIL and the second conductive layer CT2. The protection layer PL may include any suitable material, and may have suitable thickness.

In some embodiments, the protection layer PL may be configured to protect the actuator 120 from ambient exposure and to ensure the reliability/stability of the actuator 120, but not limited thereto. As shown in FIG. 29, a portion of the protection layer PL may be disposed inside the trench line WL.

Optionally, in FIG. 29, the protection layer PL may be patterned for exposing a portion of the second conductive layer CT2 and/or a portion of the first conductive layer CT1, so as to form a connecting pad CPD to be electrically connected to outer device.

Figure 30:
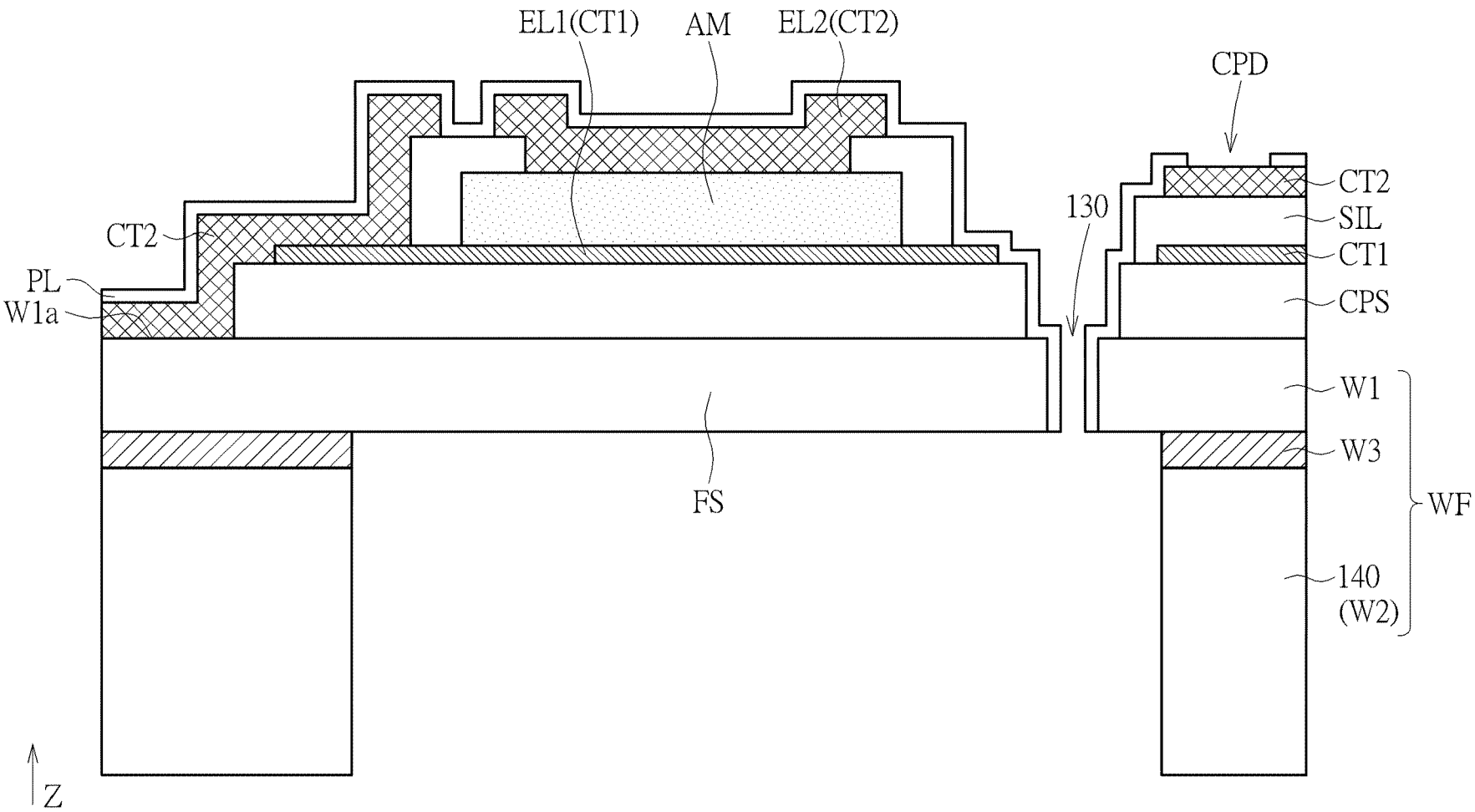

As shown in FIG. 30, the second layer W2 of the wafer WF may be patterned, so as to make the second layer W2 form at least one anchor structure 140 (and/or 240) and to make the first layer W1 form the film structure FS (e.g., including the first membrane 110 and/or the second membrane 210) anchored by the anchor structure(s) 140 (and/or 240), wherein the film structure FS includes the first membrane 110 and/or the second membrane 210. In another aspect, the film structure FS includes the first flap (the first portion) and the second flap (the second portion). In detail, the second layer W2 of the wafer WF may have a first part and a second part, the first part of the second layer W2 may be removed, and the second part of the second layer W2 may form the anchor structure 140 (and/or 240). Since the first part of the second layer W2 is removed, the first layer W1 forms the film structure FS. Namely, the components included in the film structure FS, such as the first membrane 110, the second membrane 210, the first flap and/or the second flap may be fabricated by the same process, where the same process represents the same sequence of steps illustrated in FIGS. 24-30.

Optionally, in FIG. 30, since the insulating layer W3 of the wafer WF exists, after the second layer W2 of the wafer WF is patterned, a part of the insulating layer W3 corresponding to the first part of the second layer W2 may be removed also, so as to make the first layer W1 form the film structure FS, but not limited thereto.

In FIG. 30, since the first part of the second layer W2 is removed to make the first layer W1 form the film structure FS, the slit 130 is formed within and penetrates through the film structure FS because of the trench line WL. Since the slit 130 is formed because of the trench line WL, the width of the trench line WL may be designed based on the requirement of the slit 130. For example, the width of the trench line WL may be less than or equal to 5 less than or equal to 3 μm, or less than or equal to 2 μm, so as to make the slit 130 have the gap 130P with desire width, but not limited thereto. Moreover, since a portion of the protection layer PL may be disposed inside the trench line WL, the protection layer PL may make the width of the gap 130P of the slit 130 less than the width of the trench line WL.

Figure 31:
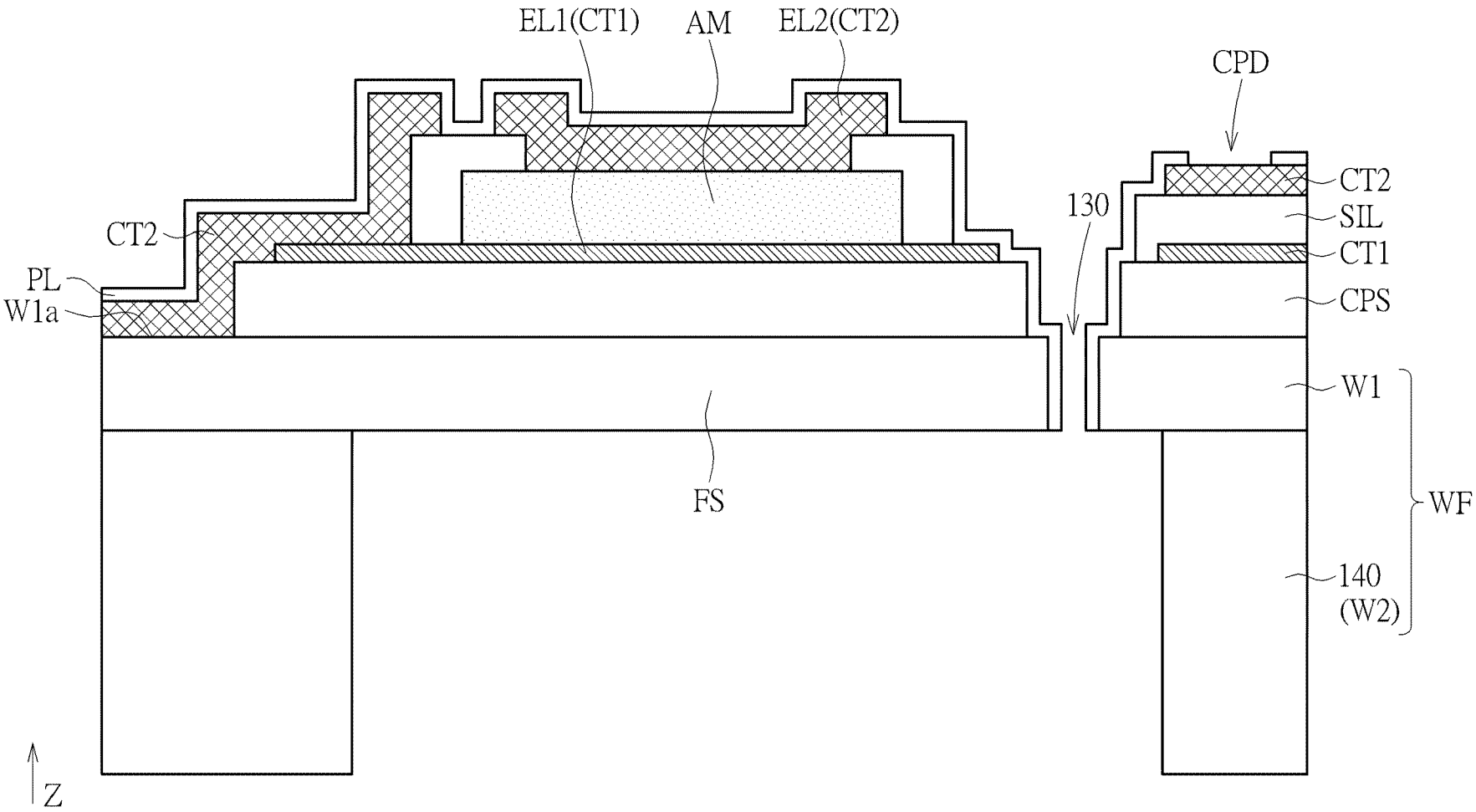
FIG. 31 is a schematic diagram illustrating a cross sectional view of an acoustic transducer according to an embodiment of the present invention.

FIG. 31 is a schematic diagram illustrating a cross sectional view of an acoustic transducer according to another embodiment of the present invention. In another embodiment, compared with the structure shown in FIG. 30, the structure shown in FIG. 31 does not have the insulating layer W3 of the wafer WF. Namely, the first layer W1 is directly formed on (in contact with) the second layer W2. As the result, the film structure FS is direct formed of the first layer W1 of the wafer WF owing to patterning the second layer W2 of the wafer WF. In this case, the first layer W1 (i.e., the film structure FS) may include an insulation layer including oxide, such as silicon dioxide, but not limited thereto.

Then, a base BS is provided, and the structure shown in FIG. 30 or the structure shown in FIG. 31 may be disposed on the base BS, so as to complete the manufacture of the acoustic transducer.

In summary, because of the existence of the slit, the acoustic transducer may generate the acoustic wave and form the vent for suppressing the occlusion effect in the first mode, and the acoustic transducer may not form the vent in the second mode. That is to say, the slit serves as the dynamic front vent of the acoustic transducer.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An acoustic transducer, disposed within a wearable sound device or to be disposed within the wearable sound device, configured to perform an acoustic transformation, the acoustic transducer comprising:

at least one anchor structure;

a film structure disposed within a first layer and anchored by the at least one anchor structure disposed within a second layer, wherein the film structure comprises a membrane, and a slit is formed within the membrane; and an actuator disposed on the film structure, the actuator configured to actuate the film structure to form a vent temporarily;

wherein the film structure partitions a space into a first volume to be connected to an ear canal of a wearable sound device user and a second volume to be connected to an ambient of the wearable sound device;

wherein the ear canal and the ambient are to be connected via the vent temporarily opened when the film structure is actuated;

wherein the slit divides the membrane into a first membrane portion and a second membrane portion, the first membrane portion is actuated to have a first displacement, and the second membrane portion is actuated to have a second displacement;

wherein over a segment of the slit, a difference between the first displacement of the first membrane portion and the second displacement of the second membrane portion is larger than a thickness of the membrane, and the vent is formed over the segment of the slit.

2. The acoustic transducer of claim 1, wherein the membrane is configured to perform the acoustic transformation.

3. The acoustic transducer of claim 1, wherein the membrane is configured to be actuated to form the vent, and the vent is formed because of the slit.

4. The acoustic transducer of claim 1, wherein a portion of the film structure by the slit makes no physical contact with any other component within the acoustic transducer.

5. The acoustic transducer of claim 1, wherein the film structure comprises:

a first flap disposed within the first layer, the first flap comprising:

a first end anchored by a first anchor structure of the at least one anchor structure; and a second end configured to perform a first up-and-down movement to form the vent.

6. The acoustic transducer of claim 5, wherein the film structure comprises:

a second flap disposed within the first layer, the second flap comprising:

a first end anchored by a second anchor structure of the at least one anchor structure; and a second end opposite to the second end of the first flap and configured to perform a second up-and-down movement to form the vent.

7. The acoustic transducer of claim 6, wherein the membrane configured to perform the acoustic transformation comprises the first flap and the second flap.

8. The acoustic transducer of claim 1, wherein the wearable sound device further comprises a housing structure, and the space divided into the first volume and the second volume is formed within the housing structure.

9. The acoustic transducer of claim 1, wherein the wearable sound device further comprises:

a sensing device configured to generate a sensing result;

wherein whether the vent is formed is determined according to the sensing result.

10. The acoustic transducer of claim 9, wherein the vent is to be opened when a sensed quantity indicated by the sensing result crosses a certain threshold with a first polarity;

the vent is to be closed when the sensed quantity crosses the certain threshold with a second polarity opposite to the first polarity.

11. The acoustic transducer of claim 9, wherein a degree of opening of the vent is to be monotonically related to a sensed quantity indicated by the sensing result.

12. The acoustic transducer of claim 9, wherein the sensing device comprises a proximity sensor, a sensed quantity indicated by the sensing result represents a distance between an object and the proximity sensor, and a degree of opening of the vent is to be correlated to the distance sensed.

13. The acoustic transducer of claim 9, wherein the sensing device comprises a motion sensor, a sensed quantity indicated by the sensing result represents a motion of the wearable sound device, and a degree of opening of the vent is to be correlated to the motion sensed.

14. The acoustic transducer of claim 1, wherein the wearable sound device comprises a driving circuit configured to generate a driving signal to actuate the membrane configured to perform the acoustic transformation;

the driving circuit comprises a frequency response equalizer;

the frequency response equalizer is enabled when the vent is opened;

the frequency response equalizer is disabled when the vent is closed.

15. The acoustic transducer of claim 1, comprising a base, wherein a back vent is formed within the base.

* * * * *